US012753774B2

(12) United States Patent
Vohra et al.

(10) Patent No.: US 12,753,774 B2
(45) Date of Patent: Oct. 6, 2026

(54) PUMP DIFFUSER ANTI-ROTATION AND ALIGNMENT ASSEMBLY

(71) Applicant: Pentair Flow Technologies, LLC, Delavan, WI (US)

(72) Inventors: Aditya Vohra, Noida (IN); Deepak Tyagi, Delhi (IN); Prasun Kumar Pandey, Chhapra (IN)

(73) Assignee: Pentair Flow Technologies, LLC, Delavan, WI (US)

( * ) Notice: Subject to any disclaimer, the term of this patent is extended or adjusted under 35 U.S.C. 154(b) by 0 days.

(21) Appl. No.: 19/294,467

(22) Filed: Aug. 8, 2025

(65) Prior Publication Data

US 2026/0043417 A1 Feb. 12, 2026

Related U.S. Application Data

(60) Provisional application No. 63/680,977, filed on Aug. 8, 2024.

(51) Int. Cl.

| | |
|---|---|
| ***F04D 29/44*** | (2006.01) |
| ***F04D 29/62*** | (2006.01) |
| *F04D 1/00* | (2006.01) |
| *F04D 29/08* | (2006.01) |

(52) U.S. Cl.

CPC ..... *F04D 29/448* (2013.01); *F04D 29/628* (2013.01); *F04D 1/00* (2013.01); *F04D 29/086* (2013.01)

(58) Field of Classification Search

CPC .... F04D 29/445; F04D 29/448; F04D 29/628; F04D 29/086; F04D 1/06; F04D 1/00; E21B 43/128

See application file for complete search history.

(56) References Cited

U.S. PATENT DOCUMENTS 2,598,620 A * 5/1952 Swift ..... F16H 41/28 416/180
2,978,989 A * 4/1961 Lung ..... F04D 13/10 415/217.1
3,115,840 A * 12/1963 Feltus ..... F04D 13/10 415/199.3
3,477,384 A * 11/1969 Hlinka ..... F04D 29/445 415/217.1
3,779,668 A * 12/1973 Ekey ..... F04D 1/063 416/189

(Continued)

FOREIGN PATENT DOCUMENTS

EP 4314570 A1 2/2024
WO WO-2005103499 A1 * 11/2005 ..... F04D 29/2222

*Primary Examiner* — Nathaniel E Wiehe
*Assistant Examiner* — Joshua R Beebe
(74) *Attorney, Agent, or Firm* — Husch Blackwell LLP

(57) ABSTRACT

A pump including an impeller, a housing having an alignment lug and an alignment collar disposed on an inner wall, and a diffuser having a plurality of vanes, each with a vane head on its trailing edge, the vane head including a radial alignment surface. A first vane includes a first vane head with a notch and a first radial alignment surface. The notch is configured to receive the alignment lug to limit rotational movement of the diffuser with respect to the housing, and the first radial alignment surface is positioned adjacent to the alignment collar to limit lateral movement of the diffuser with respect to the housing.

20 Claims, 45 Drawing Sheets

(56) References Cited

U.S. PATENT DOCUMENTS

| | | | | |
|---|---|---|---|---|
| 4,512,596 | A * | 4/1985 | Obrecht | F16D 1/02 285/330 |
| 4,859,144 | A * | 8/1989 | Houston | F04D 29/444 415/199.3 |
| 11,415,138 | B2 | 8/2022 | Ye et al. | |
| 2008/0292454 | A1* | 11/2008 | Brunner | F04D 1/063 415/199.2 |
| 2017/0370379 | A1* | 12/2017 | Wilfley | F04D 29/622 |
| 2019/0285071 | A1* | 9/2019 | Webster | F04D 29/628 |
| 2022/0341435 | A1 | 10/2022 | Cheah et al. | |

* cited by examiner

PUMP DIFFUSER ANTI-ROTATION AND ALIGNMENT ASSEMBLY

RELATED APPLICATIONS

The present application claims priority to U.S. Provisional Application No. 63/680,977 filed Aug. 8, 2024, the entire content of which is hereby incorporated by reference.

BACKGROUND

Some pumping systems have single or multi-stage components capable of moving fluid through rotational layers assembled within a pump. For example, some pumping systems can include one or more impellers, diffusers, and various housing components. Many pumping systems require the pump stage(s) to be aligned in a specific manner. Further, alignment mechanisms within pumping systems withstand various forces from the fluid and rotational components. In some instances, these forces can damage the alignment portions and make the pump inoperable. Accordingly, an improved pumping system would be beneficial.

SUMMARY

This disclosure generally relates to a diffuser alignment system for use with various centrifugal pumps. Some embodiments include one or more diffusers or one or more impellers. Other embodiments may include multiple alignment protrusions along one or more pump stages.

For the purposes of this disclosure, "pump" can be used to refer to the wet end of a pumping assembly, e.g., inlet, outlet, one or more impellers, one or more diffusers, volute, pump housing, or other components interfacing with the fluid being pumped. In some instances "pump" can be used to refer to the dry end of a pumping assembly, e.g., the motor, motor drive, power supply, cooling fan, etc. In some instances "pump" can be used to refer to both the wet end and the dry end of a pumping assembly. Accordingly, the term "pump" can be used to refer to all components of, or only some components of, a pumping assembly having both a wet end and a dry end.

In some embodiments, a pump is provided that includes an impeller, a housing having an alignment lug and an alignment collar disposed on an inner wall, and a diffuser having a plurality of vanes, each with a vane head on its trailing edge, the vane head including a radial alignment surface. A first vane includes a first vane head with a notch and a first radial alignment surface. The notch is configured to receive the alignment lug to limit rotational movement of the diffuser with respect to the housing, and the first radial alignment surface is positioned adjacent to the alignment collar to limit lateral movement of the diffuser with respect to the housing.

In some embodiments, the diffuser is a first diffuser, which includes an alignment tab, and the pump further includes a second diffuser with an alignment post, and a volute housing having a blind hole and a recessed portion positioned on a rim of the volute housing. The blind hole is sized and shaped to receive the alignment post, and the recessed portion is sized and shaped to receive the alignment tab.

In some embodiments, the first diffuser has a first face and a second face opposite the first face, with the plurality of vanes positioned on the first face and the alignment tab positioned on the second face.

In some embodiments, the housing includes an inlet housing with an inlet housing flange and an outlet housing with an outlet housing flange, and the inlet and outlet housings are configured to be fastened together by their respective flanges to enclose the impeller, the first diffuser, the second diffuser, and the volute housing.

In some embodiments, the blind hole and the alignment post are sized and shaped such that the inlet housing flange and the outlet housing flange cannot abut one another when the alignment post is not received within the blind hole.

In some embodiments, each of the radial alignment surfaces is positioned adjacent to the alignment collar to limit lateral movement of the diffuser with respect to the housing.

In some embodiments, the notch and the alignment lug form an anti-rotation mechanism that prevents the diffuser from rotating relative to the outlet housing, and the anti-rotation mechanism requires only one point of rotational contact.

In some embodiments, the notch includes a U-shape having a first surface, a second surface, and a third surface, and the alignment lug is configured to engage one of the first or the second surface when the inlet housing is engaged with the outlet housing.

In some embodiments, the alignment lug is provided as a substantially rectangular prism extending outwardly from the alignment collar on the outlet housing.

In some embodiments, a method of assembling a pump is provided that includes seating a diffuser against an outlet housing of a pump housing, engaging a notch on a first vane of the diffuser with an alignment lug projecting from the outlet housing such that rotation of the diffuser is limited relative to the outlet housing, and coupling the outlet housing to an inlet housing to seal the pump housing.

In some embodiments, the notch further includes a U-shape defined by opposed first and second surfaces and a third surface, and the alignment lug includes a substantially rectangular prism extending outwardly from an alignment collar on the outlet housing.

In some embodiments, engaging the notch with the alignment lug further includes inserting the substantially rectangular prism into the U-shape of the notch.

In some embodiments, the method further includes contacting a front surface of the alignment collar with a rear surface of the first vane, such that the alignment lug is prevented from engaging the third surface.

In some embodiments, the diffuser is a first diffuser, and the method further includes seating a second diffuser between the first diffuser and a volute housing, wherein the volute housing engages the inlet housing.

In some embodiments, the first diffuser includes an alignment tab protruding outwardly from a front face, the volute housing includes a recessed portion defined on a rear portion, and the method further includes mating the first diffuser with the volute housing by positioning the alignment tab into the recessed portion.

In some embodiments, the second diffuser includes an alignment post extending outwardly from a second vane, the volute housing includes a blind hole on a rear portion, and the method further includes inserting the alignment post into the blind hole.

In some embodiments, the method further includes compressing a gasket between the inlet housing and the outlet housing to seal the pump housing. In some embodiments, compressing the gasket cannot be accomplished if the alignment post is not received into the blind hole.

In some embodiments, a pump diffuser for mounting in a pump housing is provided that includes a front portion and a rear portion, the rear portion having a plurality of vanes, each vane having a vane head on a trailing edge, the vane head including a radial alignment surface, and a first vane of the plurality of vanes includes a notch configured to engage an alignment lug projecting from the pump housing to limit rotational movement of the diffuser with respect to the pump housing.

In some embodiments, the first vane includes a first radial alignment surface, and the first radial alignment surface is configured to engage the pump housing to limit lateral movement of the diffuser with respect to the pump housing.

DETAILED DESCRIPTION

Figure 1:
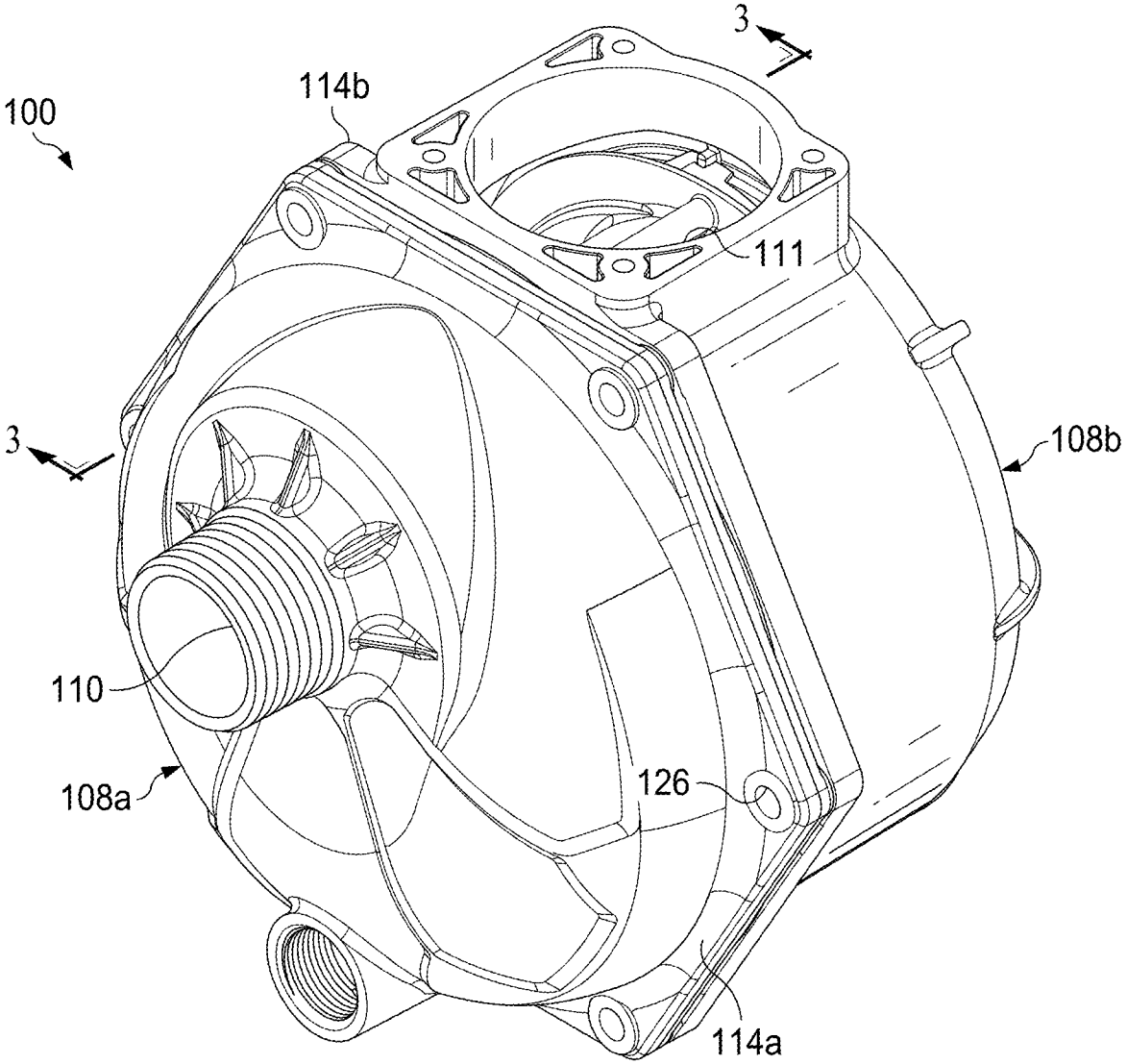
FIG. 1 is a front left isometric view of one embodiment of a pump.
Figure 2:
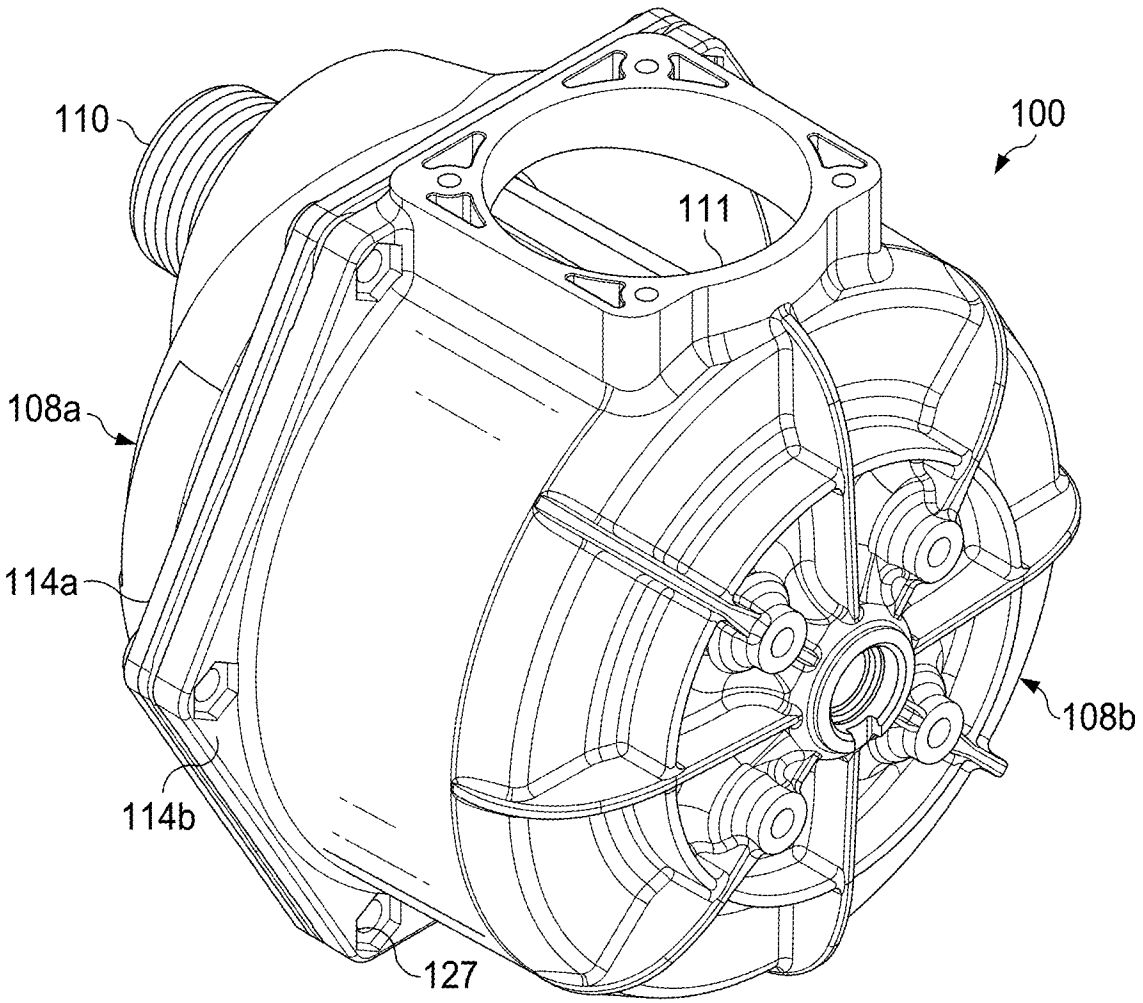
FIG. 2 is a rear left isometric view of the pump of FIG. 1.
Figure 3:
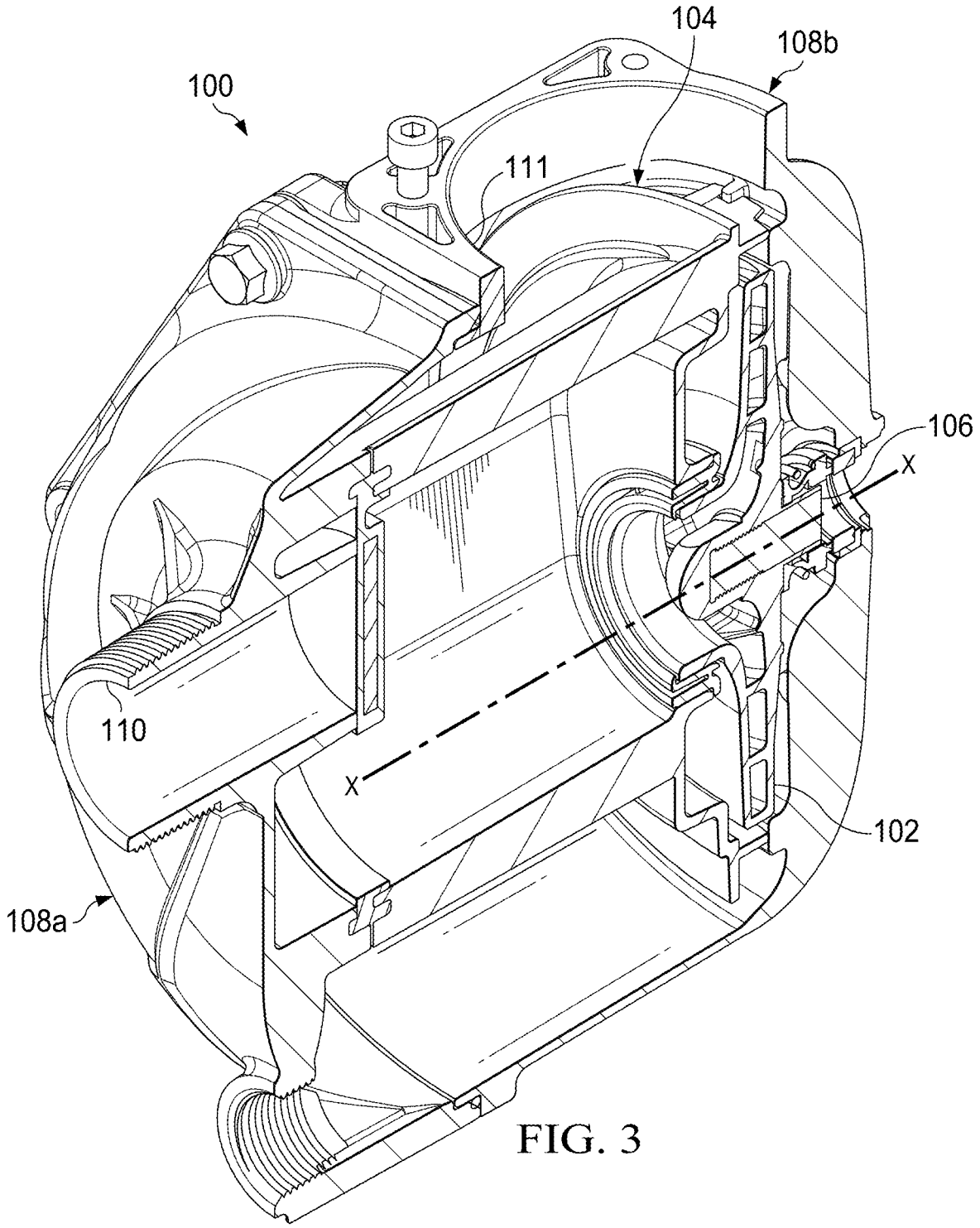
FIG. 3 is an isometric section view of the pump of FIG. 1 taken along line 3-3 of FIG. 1.
Figure 4:
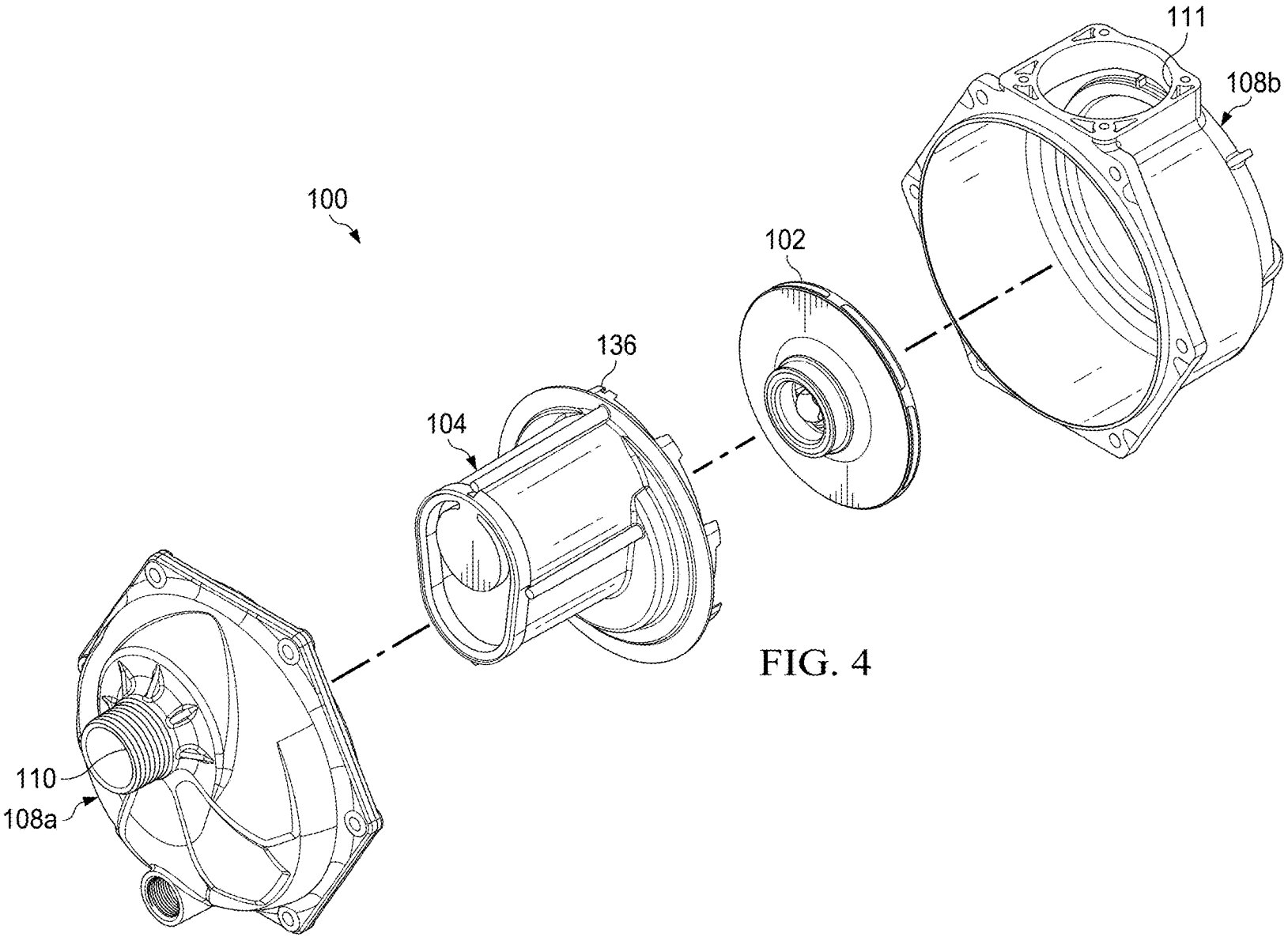
FIG. 4 is an exploded front left isometric view of the pump of FIG. 1.
Figure 5:
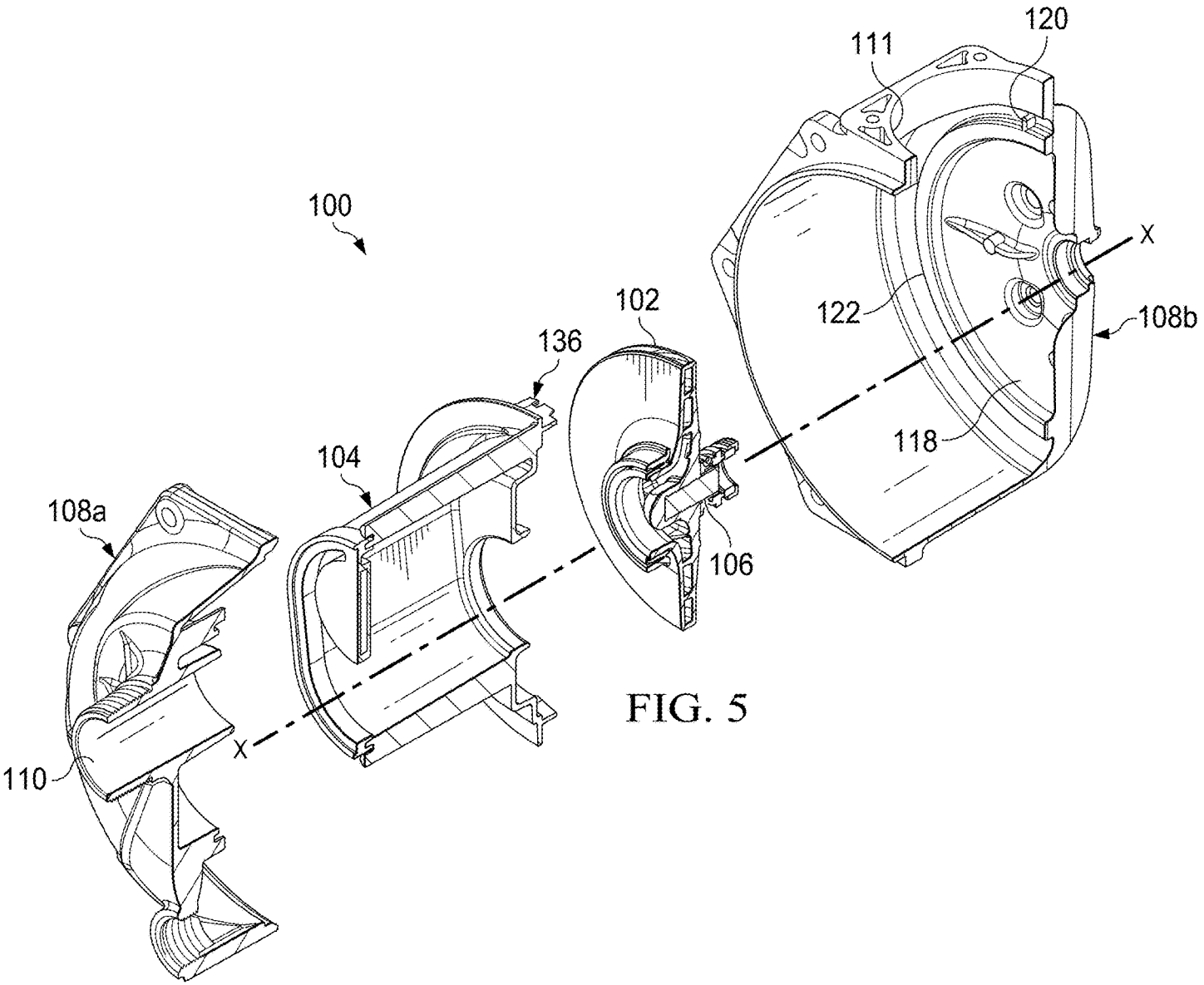
FIG. 5 is an exploded isometric section view of the pump of FIG. 1 taken along line 3-3 of FIG. 1.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to the embodiments shown but are to be accorded the widest scope consistent with the principles and features disclosed herein. The figures, which are not necessarily to scale, depict selected embodiments and are not intended to limit the scope of embodiments of the invention. Skilled artisans will recognize that the examples provided herein have many useful alternatives that fall within the scope of embodiments of the invention.

It is to be understood that the phraseology and terminology used herein are for the purpose of description and should not be regarded as limiting. For example, the use of "including," "comprising," or "having" and variations thereof herein is meant to encompass the items listed thereafter and equivalents thereof, as well as additional items. As used herein, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise specified or limited, "at least one of A, B, and C," and similar other phrases, are meant to indicate A, or B, or C, or any combination of A, B, and/or C. As such, this phrase, and similar other phrases can include single or multiple instances of A, B, and/or C, and, in the case that any of A, B, and/or C indicates a category of elements, single or multiple instances of any of the elements of the categories A, B, and/or C.

FIGS. 1-5 illustrate a first embodiment of a wet end 100 of a multi-stage pump. The wet end 100 of the multi-stage pump may include an impeller 102, a first diffuser 104, a drive shaft 106, and a pump housing including an inlet housing 108*a* and an outlet housing 108*b*. The multi-stage pump can further include a dry end with a motor (not shown) and a motor drive (not shown) that are configured to drive the drive shaft 106. Here, the inlet housing 108*a* includes an inlet member 110, and the outlet housing 108*b* includes an outlet member 111. When properly assembled, the inlet housing 108*a*, the outlet housing 108*b*, the impeller 102, and the first diffuser 104 are axially aligned along an axis X-X that extends through the drive shaft 106. In particular, the impeller 102 and the drive shaft 106 are concentrically aligned along the axis X-X. The outlet housing 108*b* forms an interior volume into which the impeller 102 and a portion of the first diffuser 104 are received. Here, the pump components are arranged from back (outlet end) to front (inlet end) in the following order: the outlet housing 108*b*, the impeller 102, the first diffuser 104, and the inlet housing 108*a*.

Figure 6:
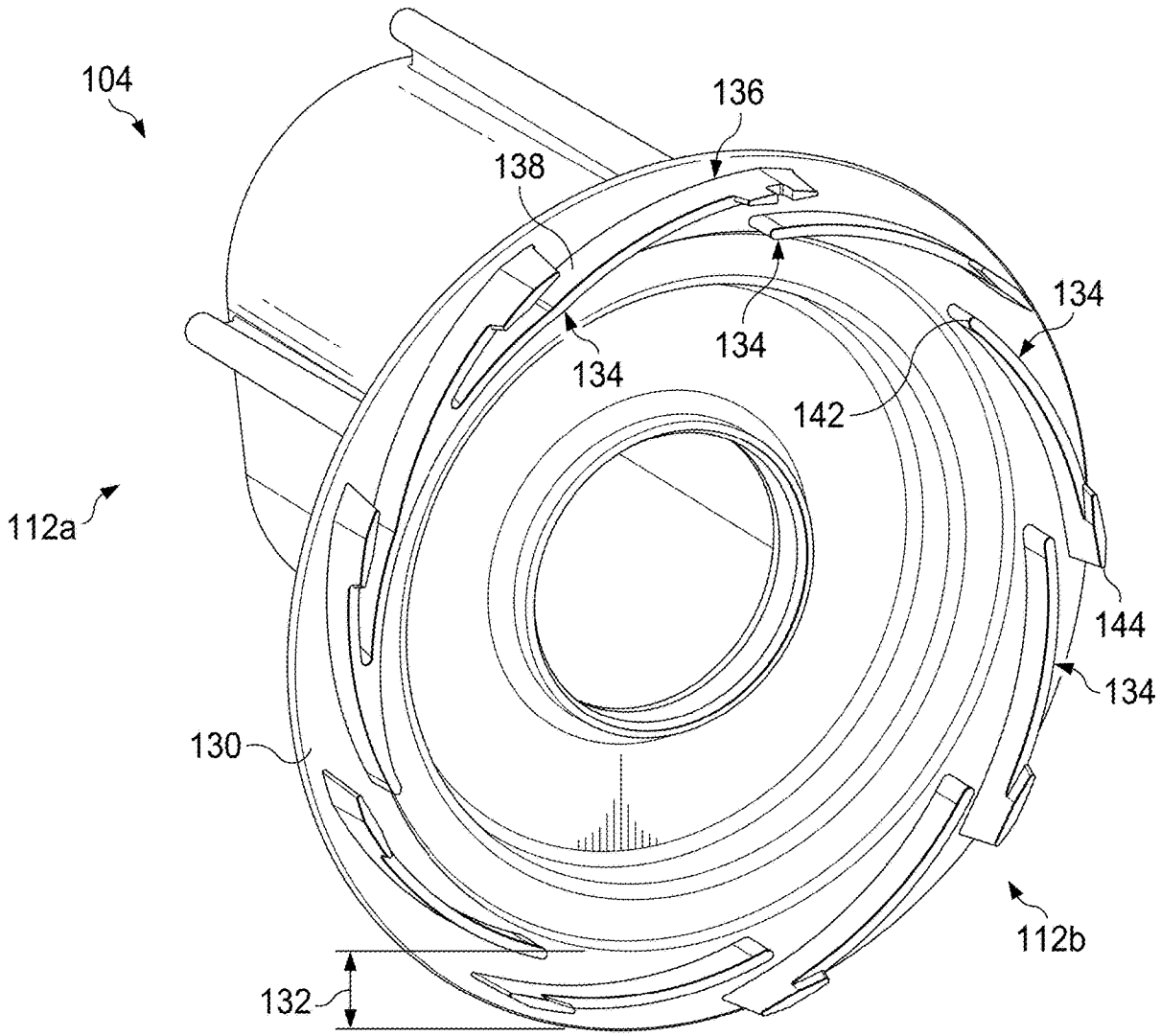
FIG. 6 is a rear left isometric view of a first diffuser of the pump of FIG. 1.
Figure 7:
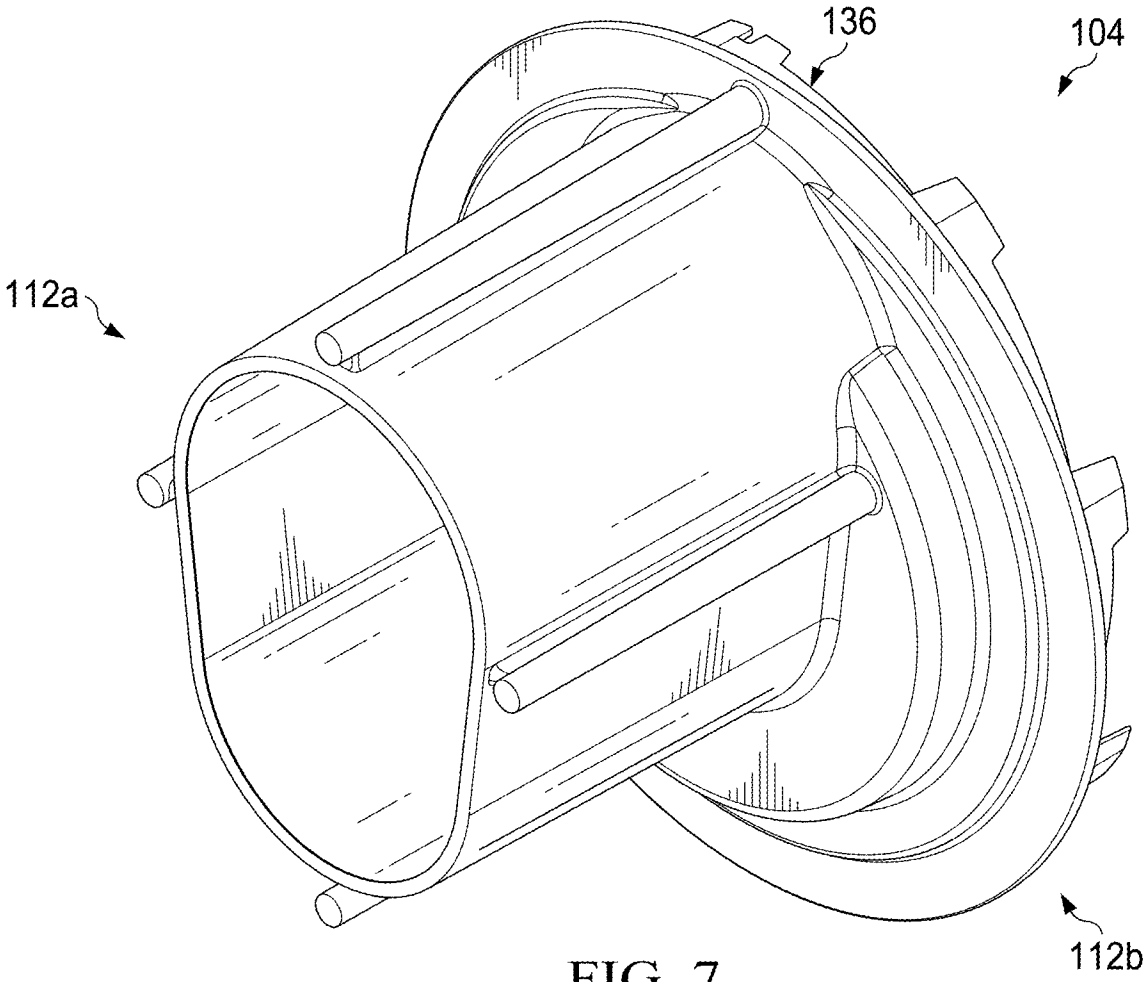
FIG. 7 is a front left isometric view of the first diffuser of FIG. 6.
Figure 8:
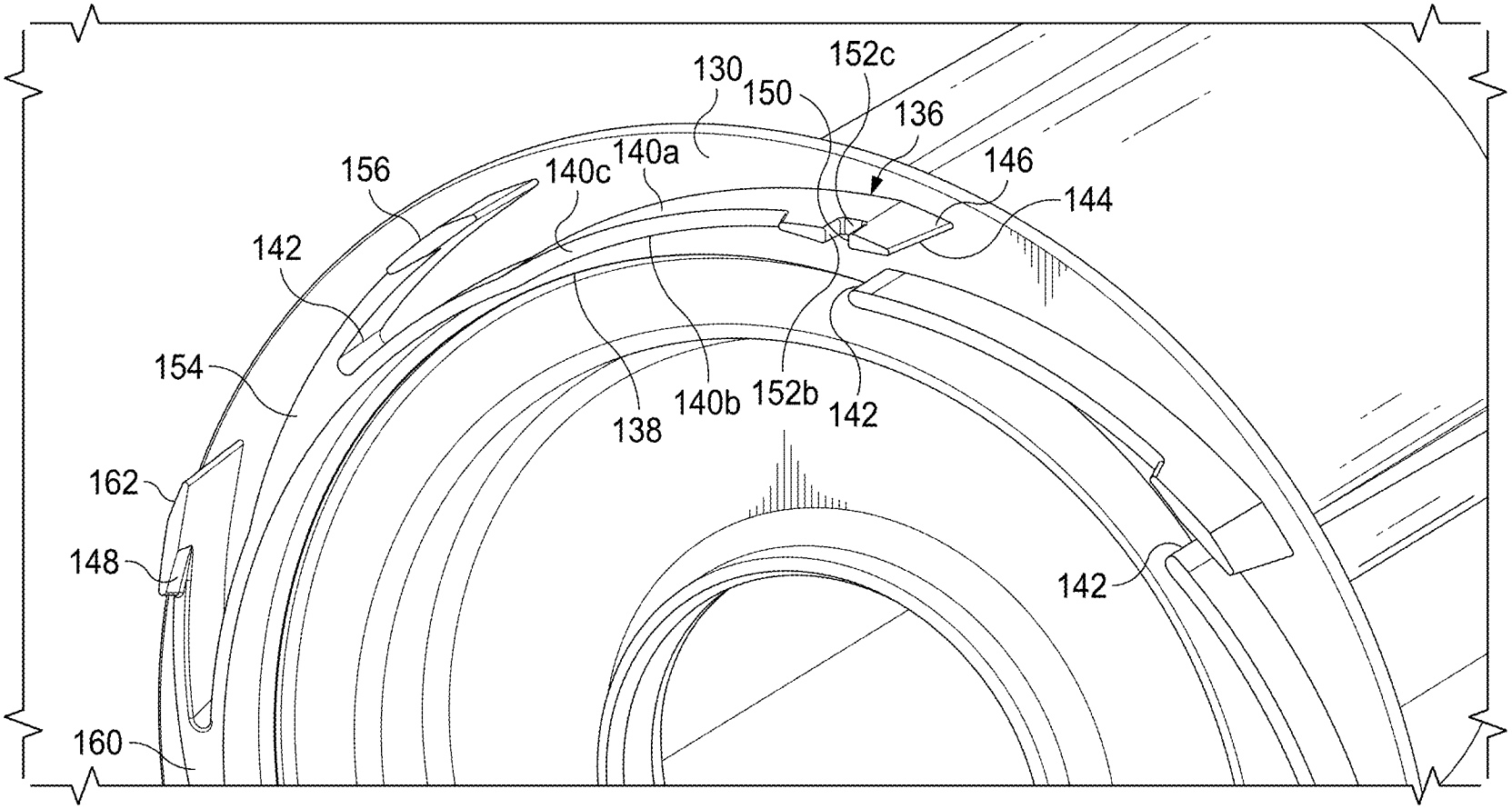
FIG. 8 is a partial rear right isometric view of the first diffuser of FIG. 6.
Figure 9:
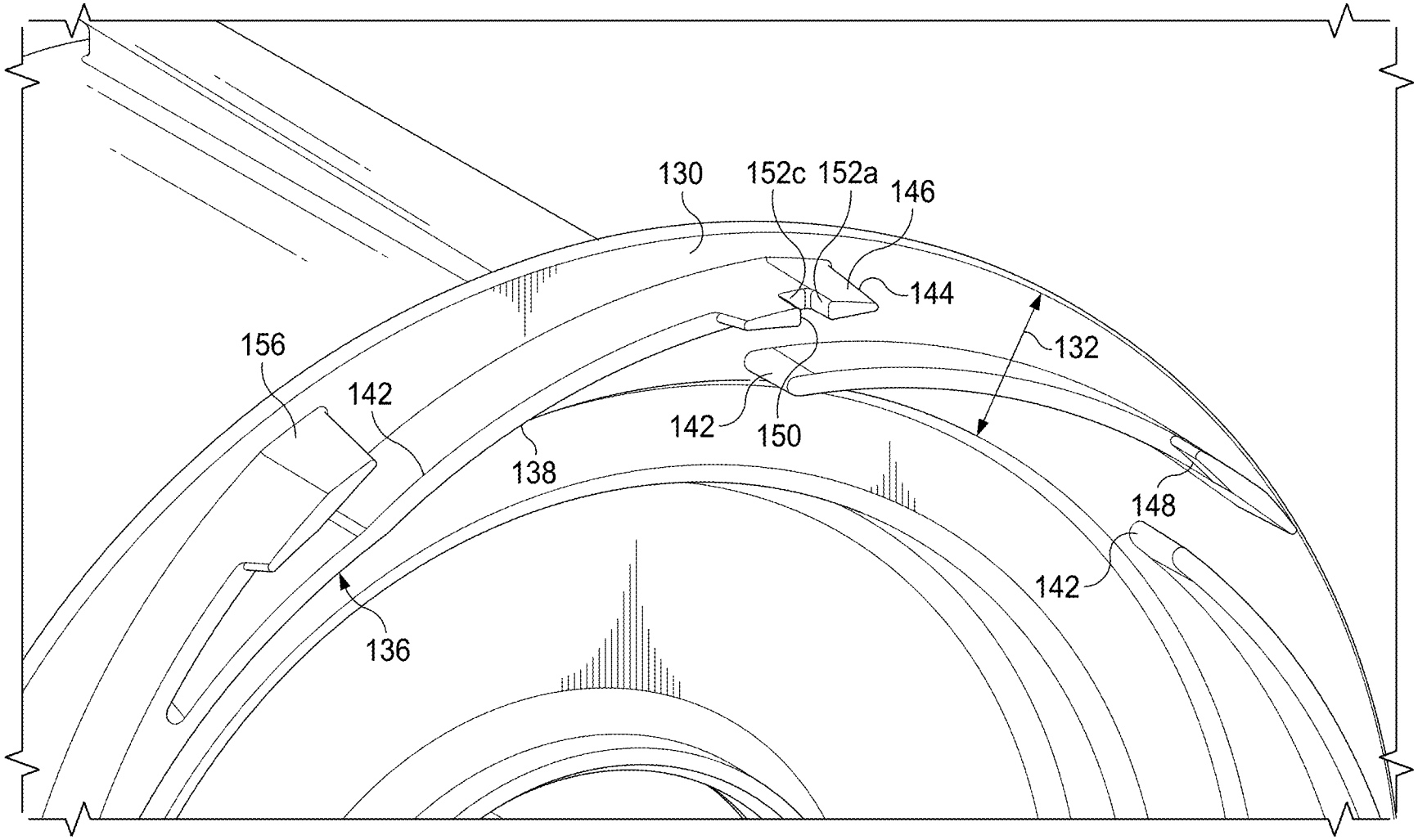
FIG. 9 is a partial rear left isometric view of the first diffuser of FIG. 6.
Figure 10:
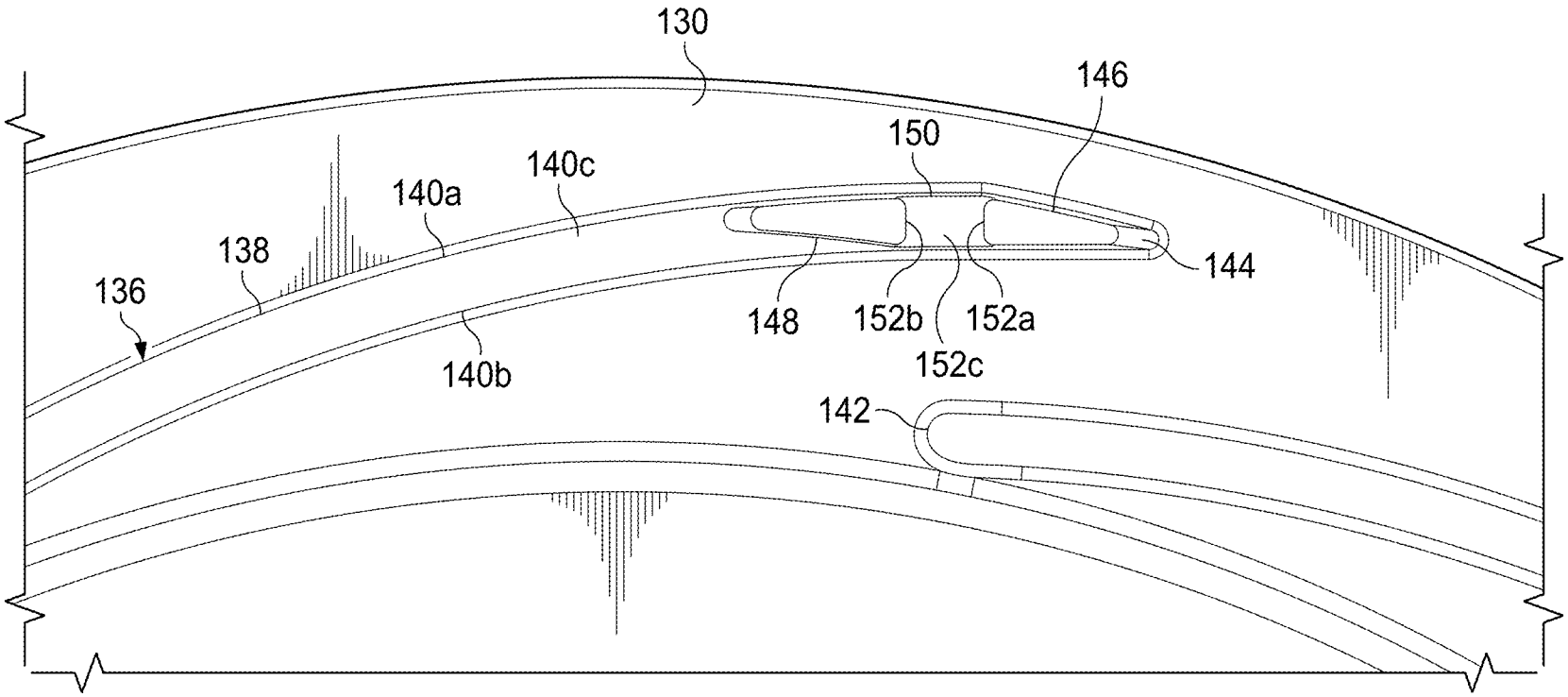
FIG. 10 is a partial rear view of the first diffuser of FIG. 6.
Figure 11:
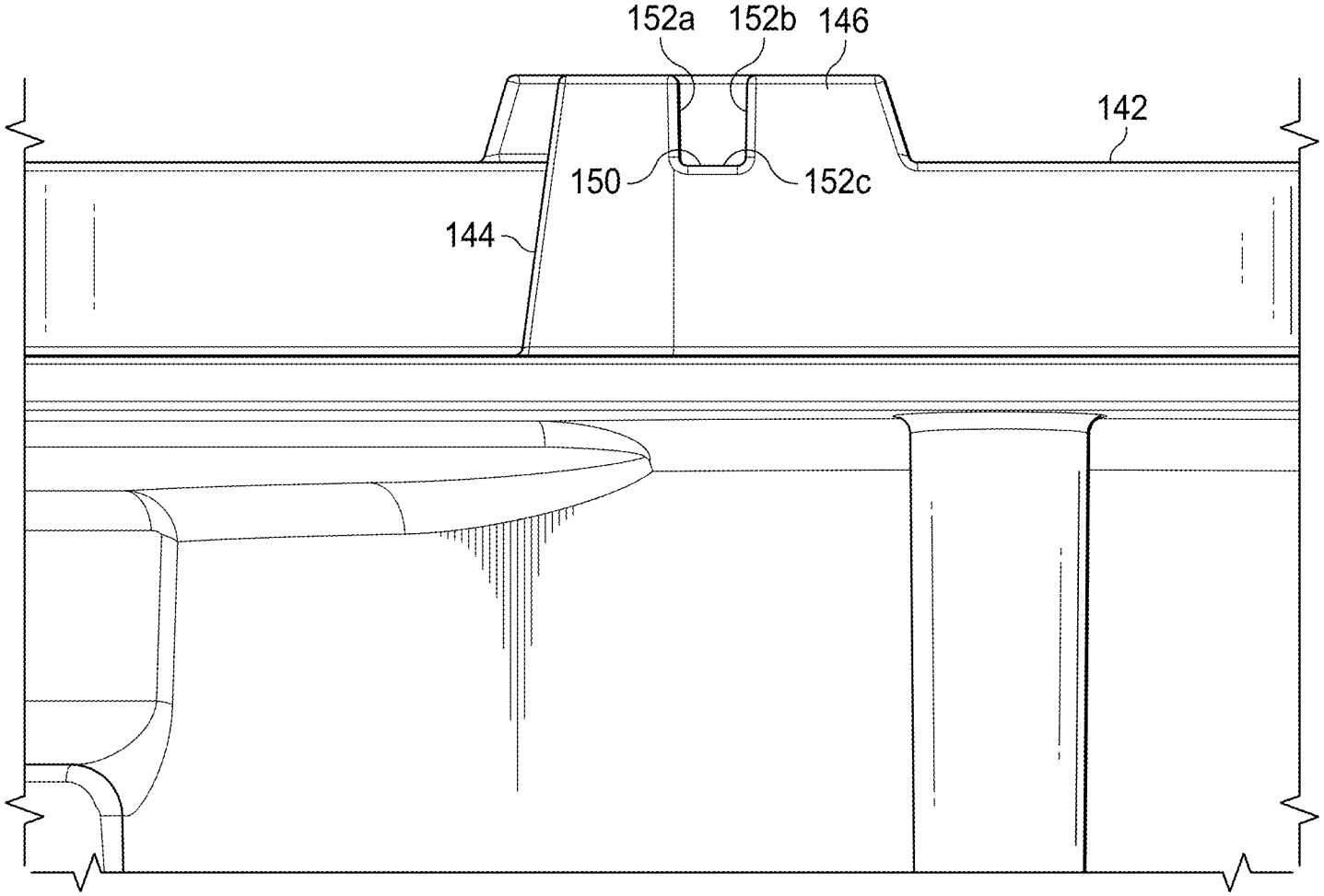
FIG. 11 is a partial top view of the first diffuser of FIG. 6.

FIGS. 6-12 illustrate the first diffuser 104 and aspects thereof in detail. The first diffuser 104 includes a front portion 112*a* and a back portion 112*b*. The back portion 112*b* is provided in the form of a disc with a rear face 130. Further, the back portion 112*b* includes a plurality of vanes 134 that each has a width dimension that extends outward from the rear face 130. The plurality of vanes 134 is arranged on an outer circumferential region 132 of the rear face 130, and each vane of the plurality of vanes 134 extends radially toward the outer circumference of the back portion 112*b*. Each vane of the plurality of vanes 134 is substantially arc-shaped and includes a vane body 138, a leading edge 142, and a trailing edge 144, as shown in FIG. 6. Further, the vane body 138 includes an outer surface 140*a*, an inner surface 140*b*, and a rear surface 104*c* as shown in FIG. 8. The trailing edge 144 includes a vane head 146 that extends outward from the rear surface 140*c* of the vane body 138 and away from the rear face 130 of the first diffuser 104. In some forms, the side profile of the vane head 146, e.g., the shape of the vane head 146 when viewed normal to the rear face 130 of the first diffuser 104, is provided in the form of a thin parallelogram (see FIG. 10). Each vane head 146 includes an inner radial alignment surface 148 that is angled to extend radially away from the inner surface 140*b* of the vane body 138 toward the outer surface 140*a* of the vane body 138 (see FIG. 10). As a result, each vane head 146 tapers as it extends toward the leading edge 142.

A first vane 136 of the plurality of vanes 134 includes a notch 150 that extends into the vane head 146. The notch 150 of the first vane 136 comprises a first inner surface 152*a* and a second inner surface 152*b* on either side of the notch 150 that are positioned to face toward one another. In some embodiments, the notch 150 is provided in the form of a U-shape, and a third inner surface 152*c* connects the first inner surface 152*a* and the second inner surface 152*b*. The first inner surface 152*a* and the second inner surface 152*b* can be positioned such that they are substantially parallel to one another.

Figure 12:
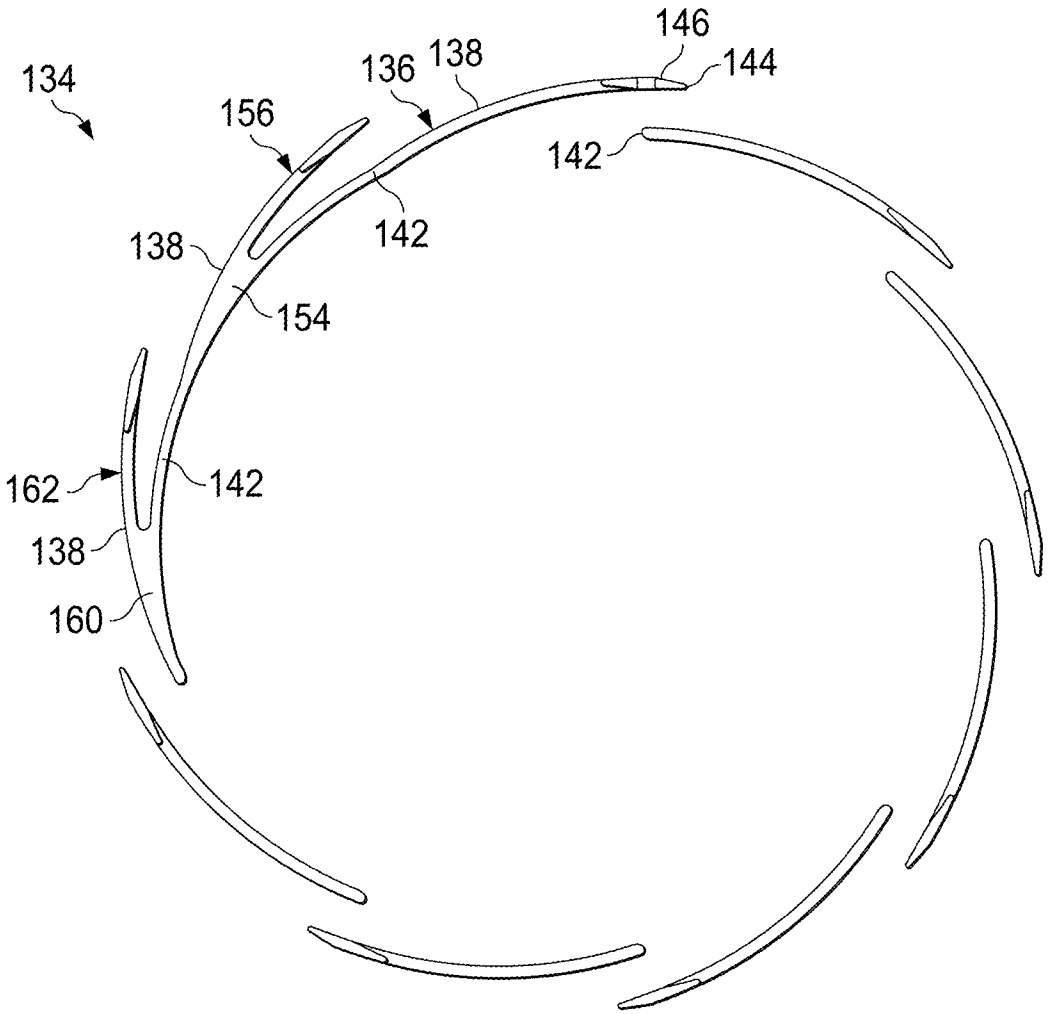
FIG. 12 is a rear view of a plurality of vanes of the first diffuser of FIG. 6.

As shown in FIG. 12, in some forms, the leading edge 142 of the first vane 136 connects with the vane body 138 of an adjacent second vane 156 to form a first vane confluence region 154. In use, the first vane confluence region 154 is configured to support the first vane 136 and the second vane 156 as they endure the forces of fluid flow through the pump. In some forms, the leading edge 142 of the second vane 156 connects with the vane body 138 of an adjacent third vane 162 to form a second vane confluence region 160. Accordingly, the second vane confluence region 160 provides additional vane support against the internal forces of fluid flow through the pump.

Figure 13:
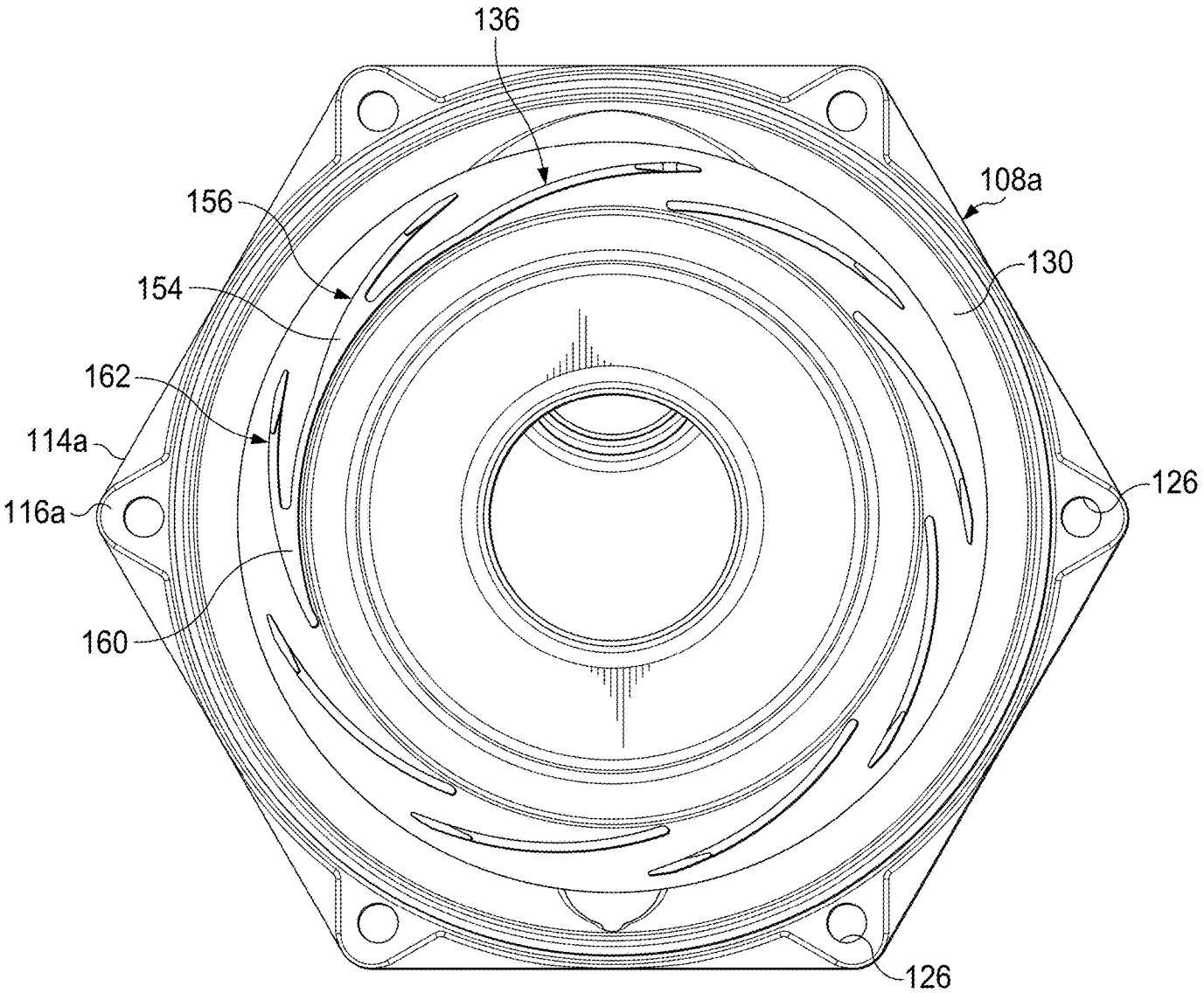
FIG. 13 is a rear view of the first diffuser and an inlet housing of the pump of FIG. 1.

FIG. 13 illustrates the first diffuser 104 being received within an inner volume formed by the inlet housing 108*a*. The inlet housing 108*a* includes an inlet housing flange 114*a* with an inlet housing flange surface 116*a*. The inlet housing flange 114*a* further includes a plurality of holes 126. In some forms, the inlet housing 108*a* includes a plurality of protruding portions on an inner surface (not shown) that are configured to mate with the front portion 112*a* of the first diffuser 104.

Figure 14:
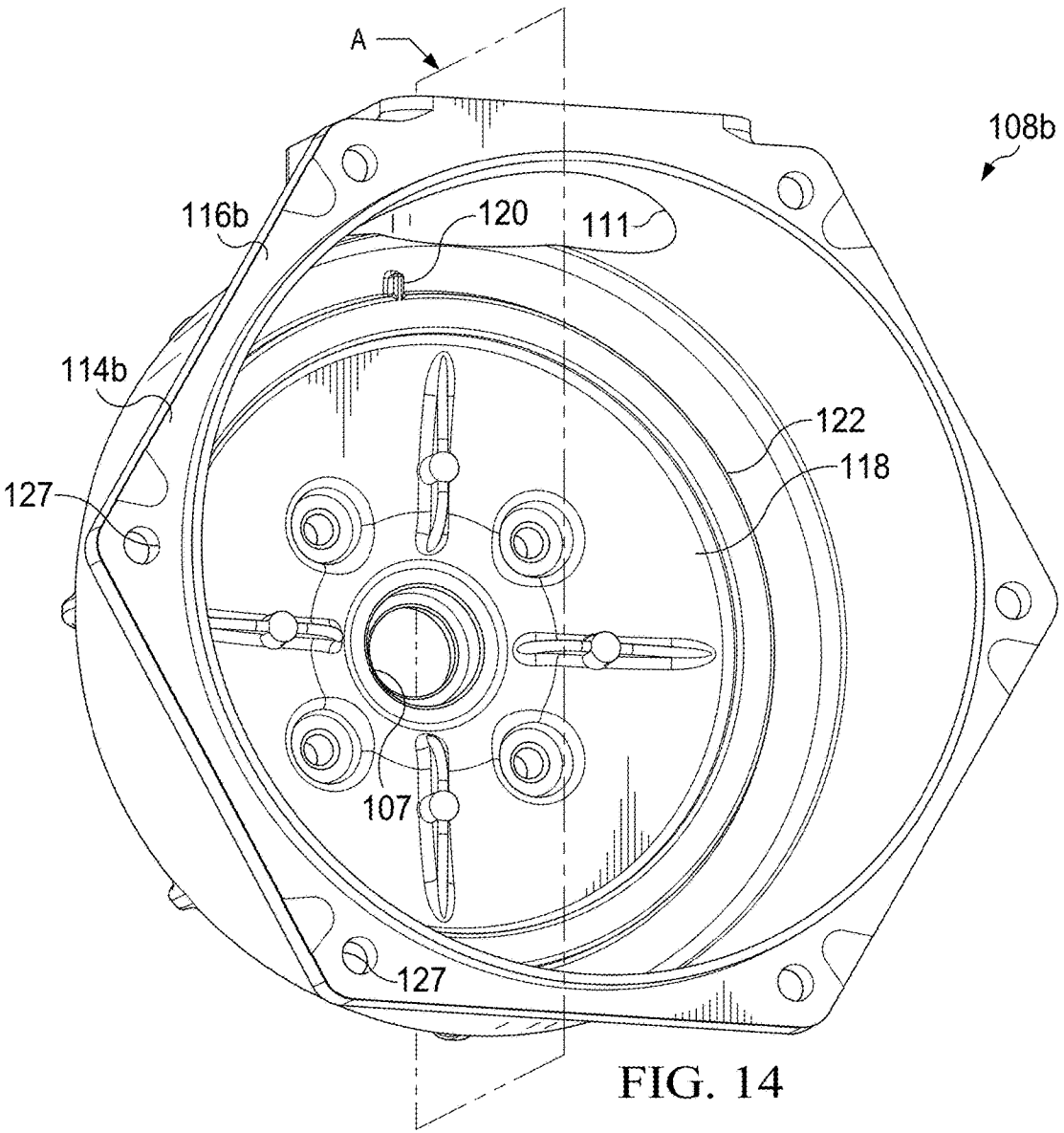
FIG. 14 is a front right isometric view of an outlet housing of the pump of FIG. 1.
Figure 15:
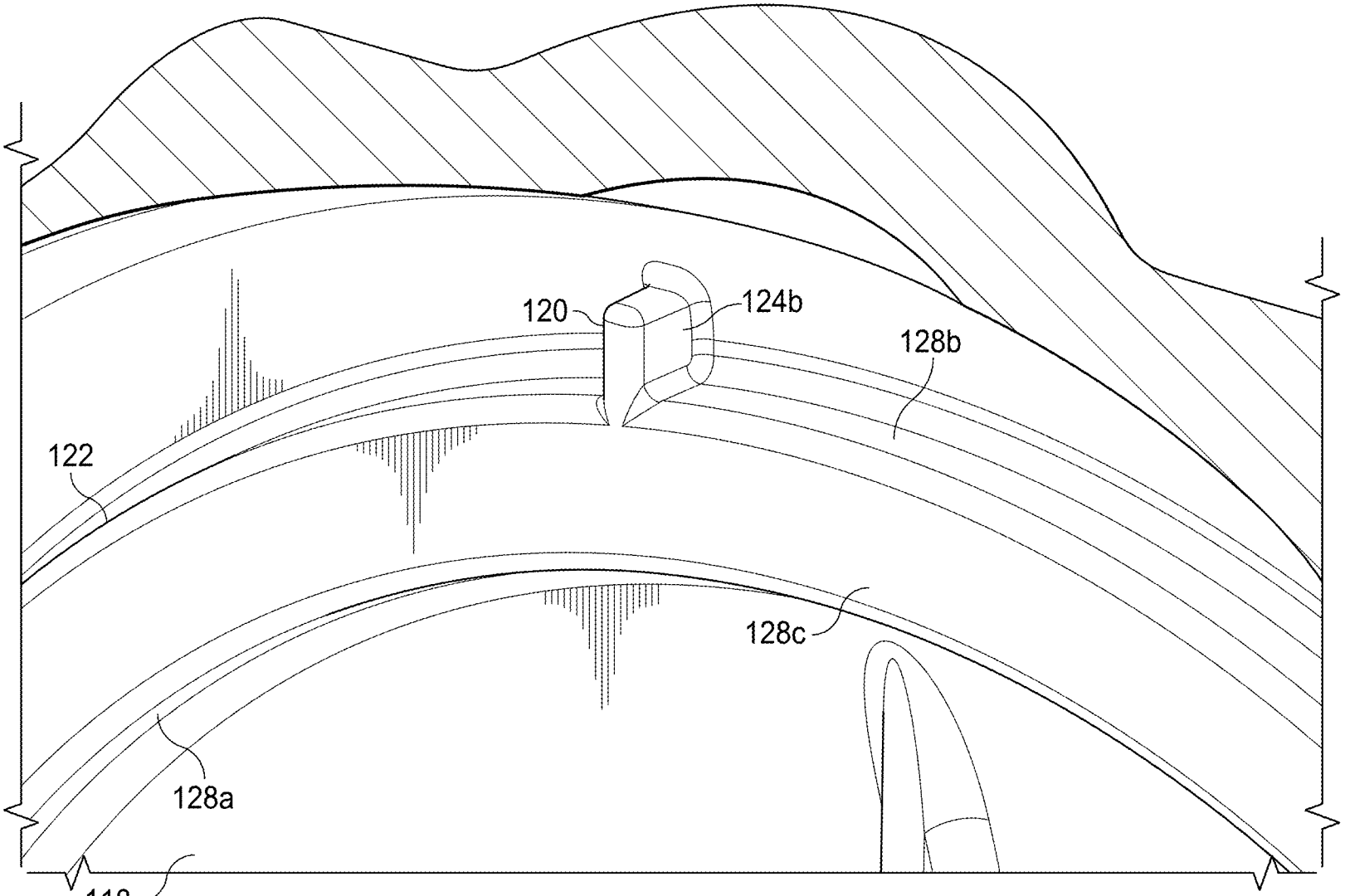
FIG. 15 is a partial front left isometric cutaway view of the outlet housing of FIG. 14.
Figure 16:
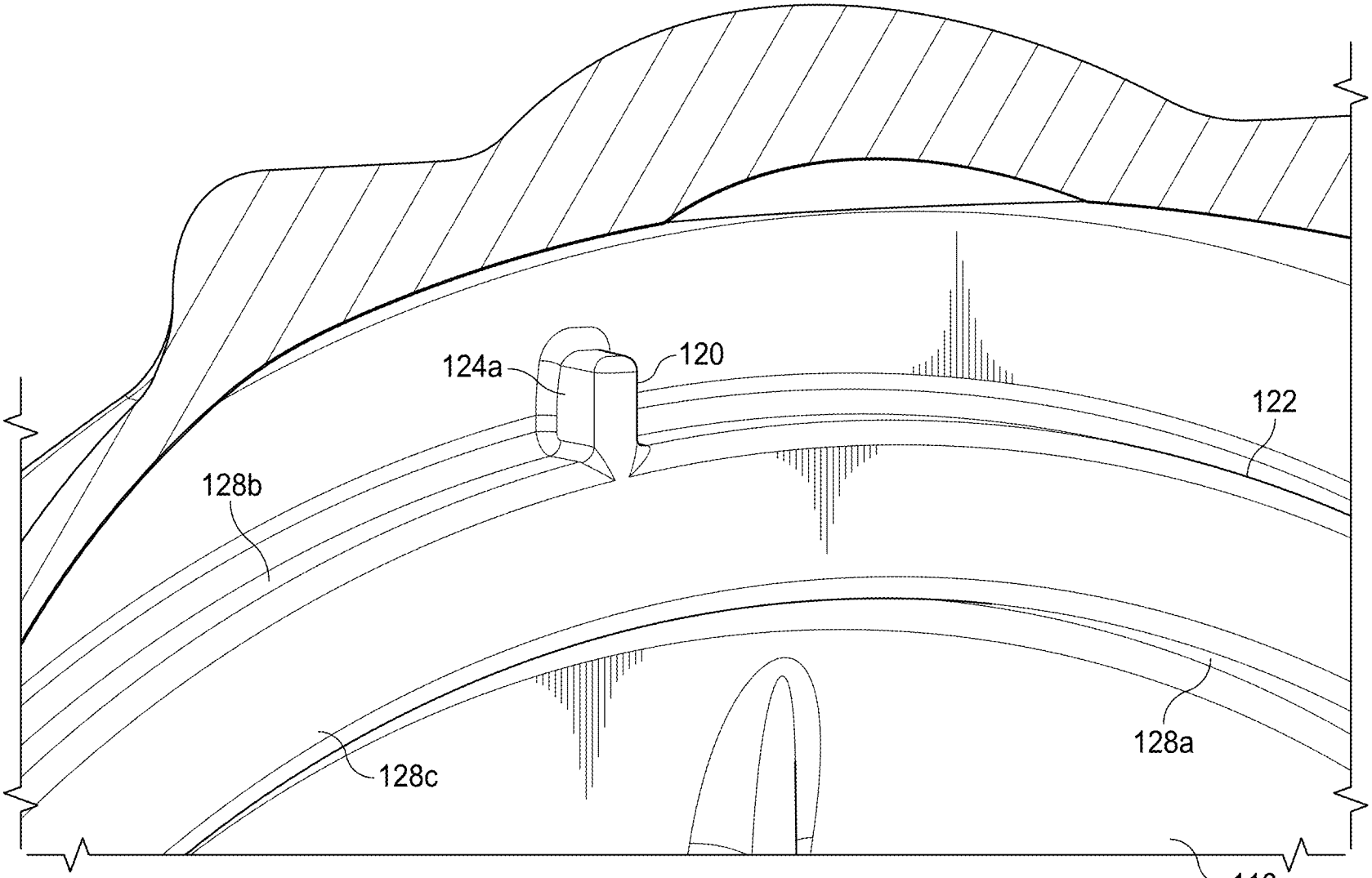
FIG. 16 is a partial front right isometric cutaway view of the outlet housing of FIG. 14.
Figure 17:
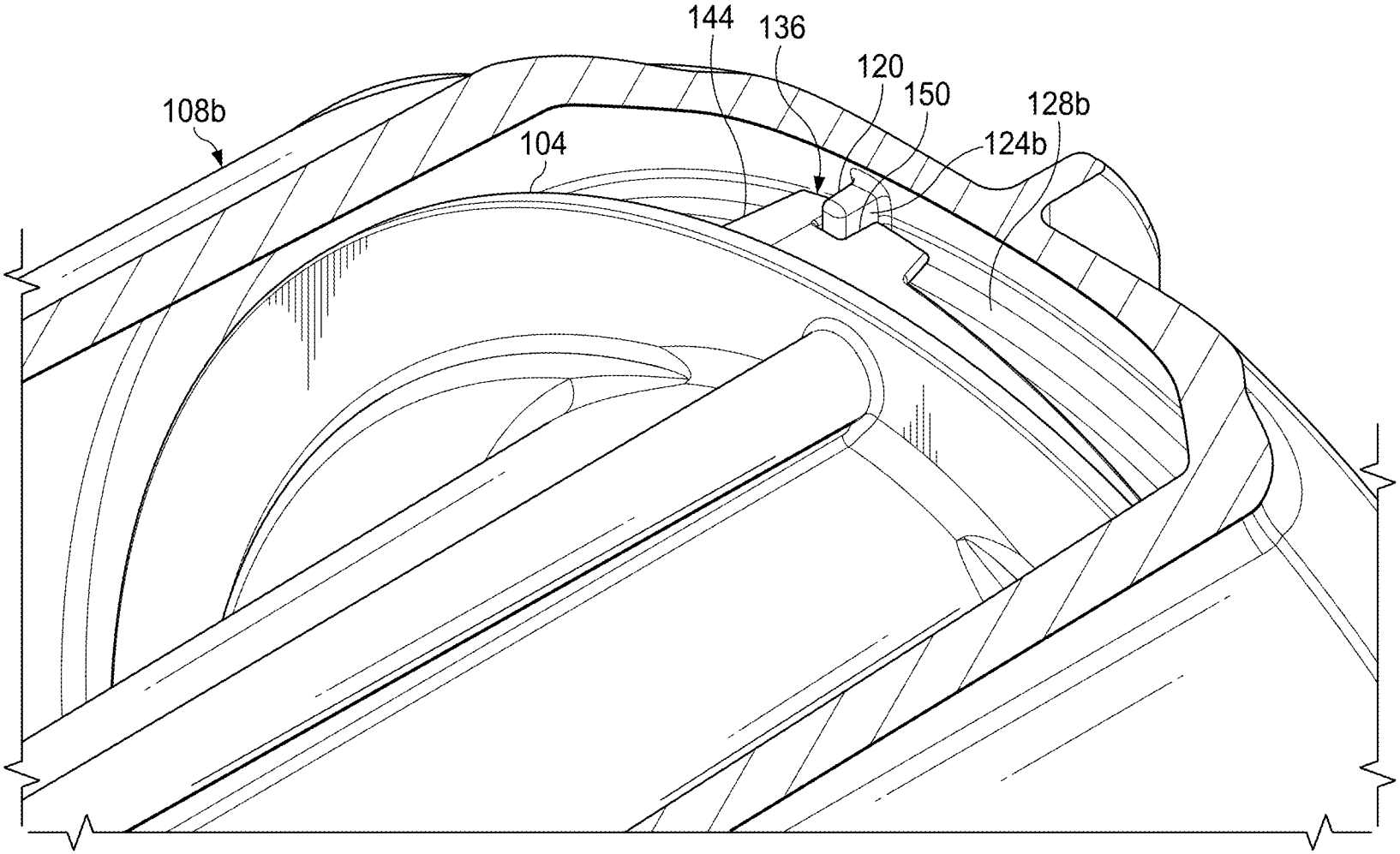
FIG. 17 is a partial front left isometric cutaway view of the pump of FIG. 1.
Figure 18:
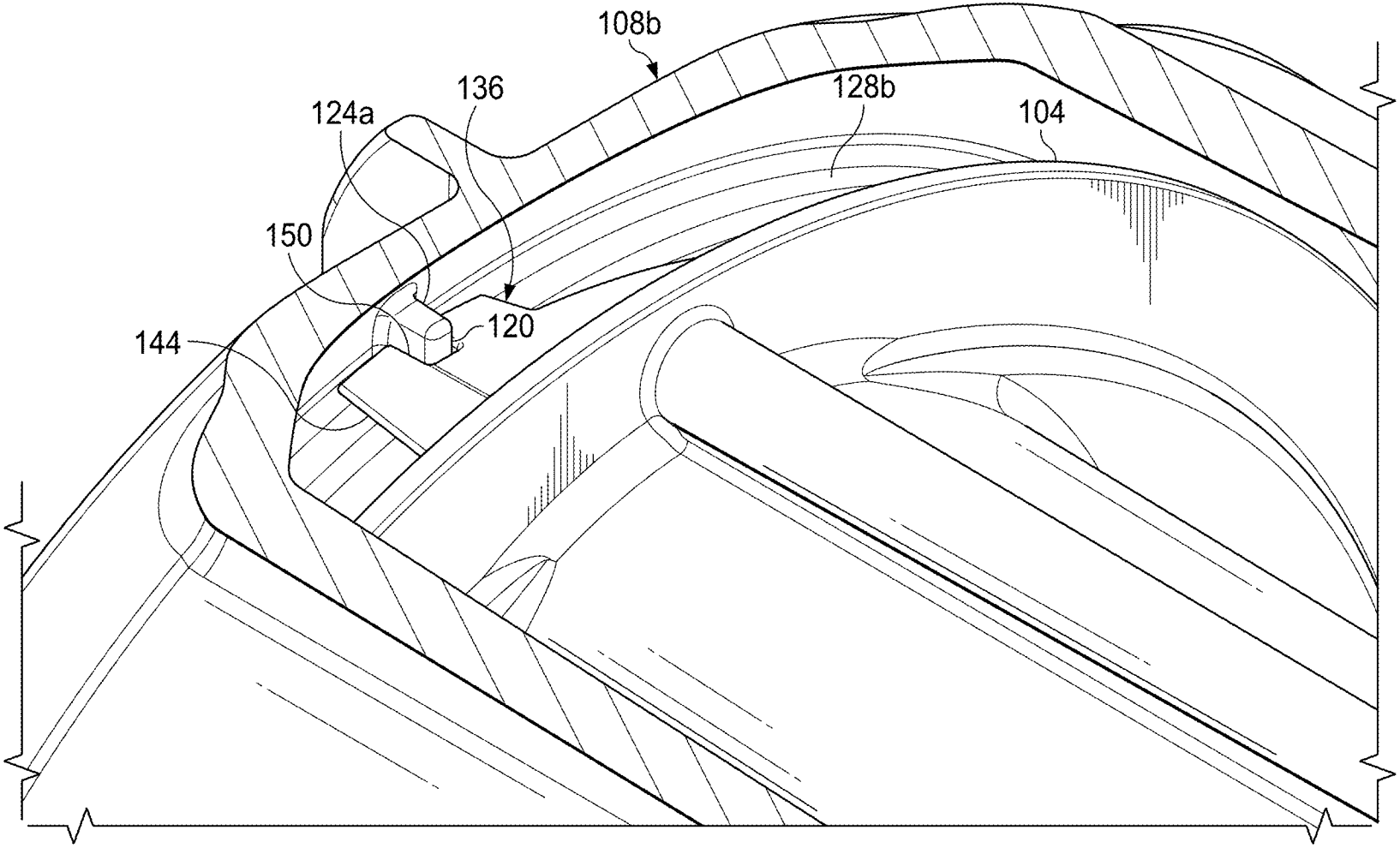
FIG. 18 is a partial front right isometric cutaway view of the pump of FIG. 1.

FIGS. 14-16 illustrate the outlet housing 108*b* and aspects thereof in detail. The outlet housing 108*b* includes an outlet housing flange 114*b* with an outlet housing flange surface 116*b*. The outlet housing flange 114*b* further includes a plurality of holes 127 radially spaced around the outlet housing flange surface 116*b*. The outlet housing flange surface 116*b* is designed to abut against the inlet housing flange surface 116*a* to hermetically seal the wet end 100. Fastening means, such as screws, bolts, nuts, clips, latches, clamps, etc., can utilize the plurality of holes 126 in the inlet housing flange 114*a* and the plurality of holes 127 in the outlet housing flange 114*b* to seal the inlet housing flange surface 116*a* firmly against the outlet housing flange surface 116*b*. In some forms, a gasket is provided between the inlet housing flange surface 116*a* and the outlet housing flange surface 116*b*. If the wet end 100 is assembled incorrectly, the inlet housing flange surface 116*a* and the outlet housing flange surface 116*b* will not abut one another or will not properly compress a gasket therebetween, which results in the pump housing not sealing correctly.

Referring further to the outlet housing 108*b*, a rear inner wall 118 is positioned at the back of the interior volume formed by the outlet housing 108*b*. The outlet housing 108*b* includes an alignment lug 120 and an alignment collar 122, which are both positioned on the inner wall 118. The alignment collar 122 can be provided in the form of a cylindrical protrusion that extends forward from the inner wall 118 into the interior volume formed by the outlet housing 108*b*. The alignment collar 122 can be positioned concentrically with the axis X-X (see FIG. 3) and concentrically with a drive shaft aperture 107 in the outlet housing 108*b* that is configured to receive the drive shaft 106 (see FIG. 1). As best shown in FIG. 15, the alignment collar 122 further comprises an inner surface 128*a* and an outer surface 128*b* that extend circumferentially around the alignment collar 122 and a front surface 128*c* that faces away from the inner wall 118.

Figure 19:
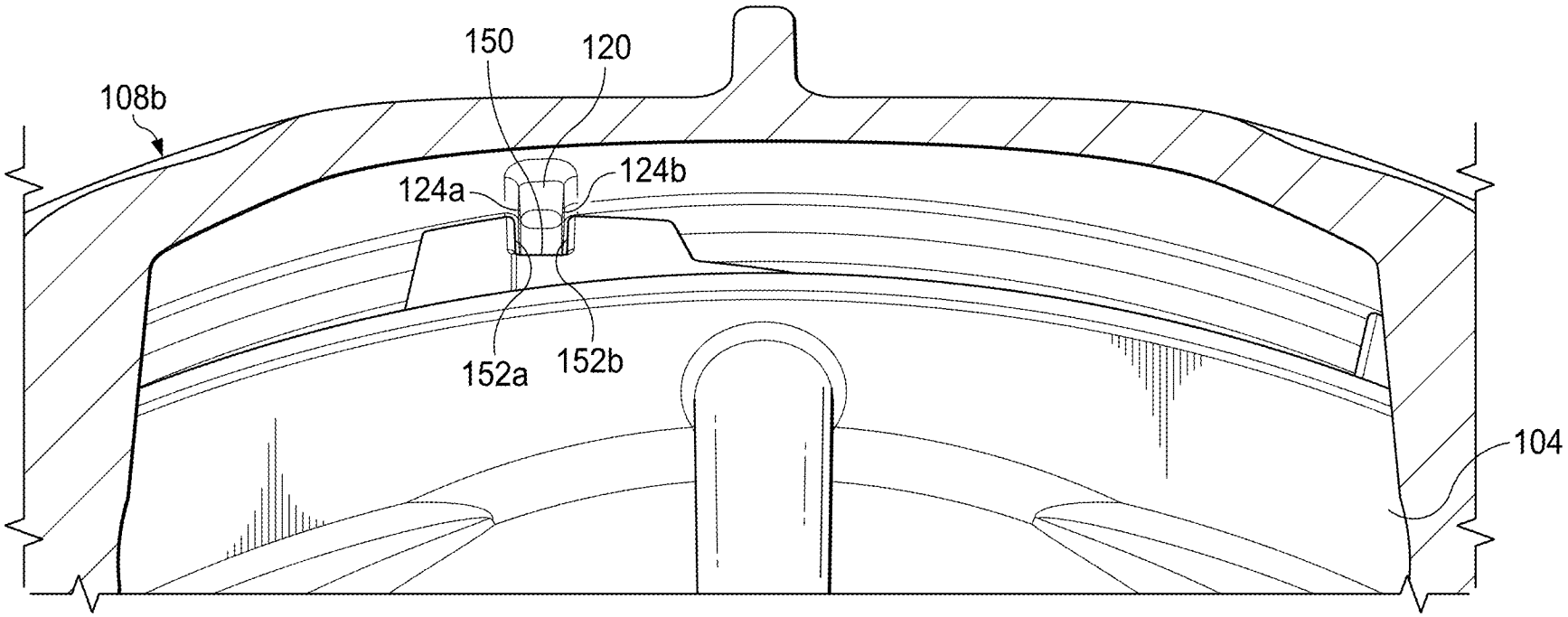
FIG. 19 is a partial front top isometric cutaway view of the pump of FIG. 1.

The alignment lug 120 can be provided in the form of a substantially rectangular prism that extends radially outward from the outer surface 128*b* of the alignment collar 122. Further, the alignment lug 120 is fixed to the inner wall 118 of the outlet housing 108*b* and the outer surface 128*b* of the alignment collar 122. The alignment lug 120 has a first side surface 124*a* and a second side surface 124*b* that define the width of the alignment lug 120 (see FIGS. 19 and 20). In some forms, the first side surface 124*a* and the second side surface 124*b* are substantially parallel to one another. In some embodiments, the alignment lug 120 extends vertically upward toward the outlet member 111. However, in some forms, the alignment lug 120 is horizontally offset from a plane A (see FIG. 14) that is defined by the axis X-X (see FIG. 3) and a center point of a cross-section of the outlet member 111. Accordingly, the alignment lug 120 does not extend vertically upward from the alignment collar 122 at the twelve o'clock position of the alignment collar 122. Instead, the alignment lug 120 is positioned on the alignment collar 122 a few degrees clockwise or counterclockwise from the twelve o'clock position on the alignment collar 122. However, despite the alignment lug 120 being offset from the twelve o'clock position on the alignment collar 122, in some forms, the alignment lug 120 still yet extends from the alignment collar 122 in a direction that is parallel to the plane A.

As illustrated in FIGS. 17-22, the outlet housing 108*b* and the first diffuser 104 have a number of features that are designed to correspondingly interact with one another to assist in the proper assembly of the wet end 100. For example, the notch 150 of the first vane 136 of the first diffuser 104 is sized and shaped to a least partially receive the alignment lug 120 of the outlet housing 108*b* when the first diffuser 104 is seated against the outlet housing 108*b*. In particular, the first, second, and third inner surfaces 152*a*, 152*b*, 152*c* (see FIG. 20), of the notch 150 are sized and shaped to partially surround the alignment lug 120. In some forms, the first inner surface 152*a* and the second inner surface 152*b* of the notch 150 are spaced apart at a distance that is greater than the width of the alignment lug 120. Accordingly, when the alignment lug 120 is received into the notch 150, a gap can form between the first side surface 124*a* of the alignment lug 120 and the first inner surface 152*a* of the notch 150 and the second side surface 124*b* of the alignment lug 120 and the second inner surface 152*b* of the notch 150. Accordingly, a loose or semi-loose fit is provided between the notch 150 and the alignment lug 120.

Figure 20:
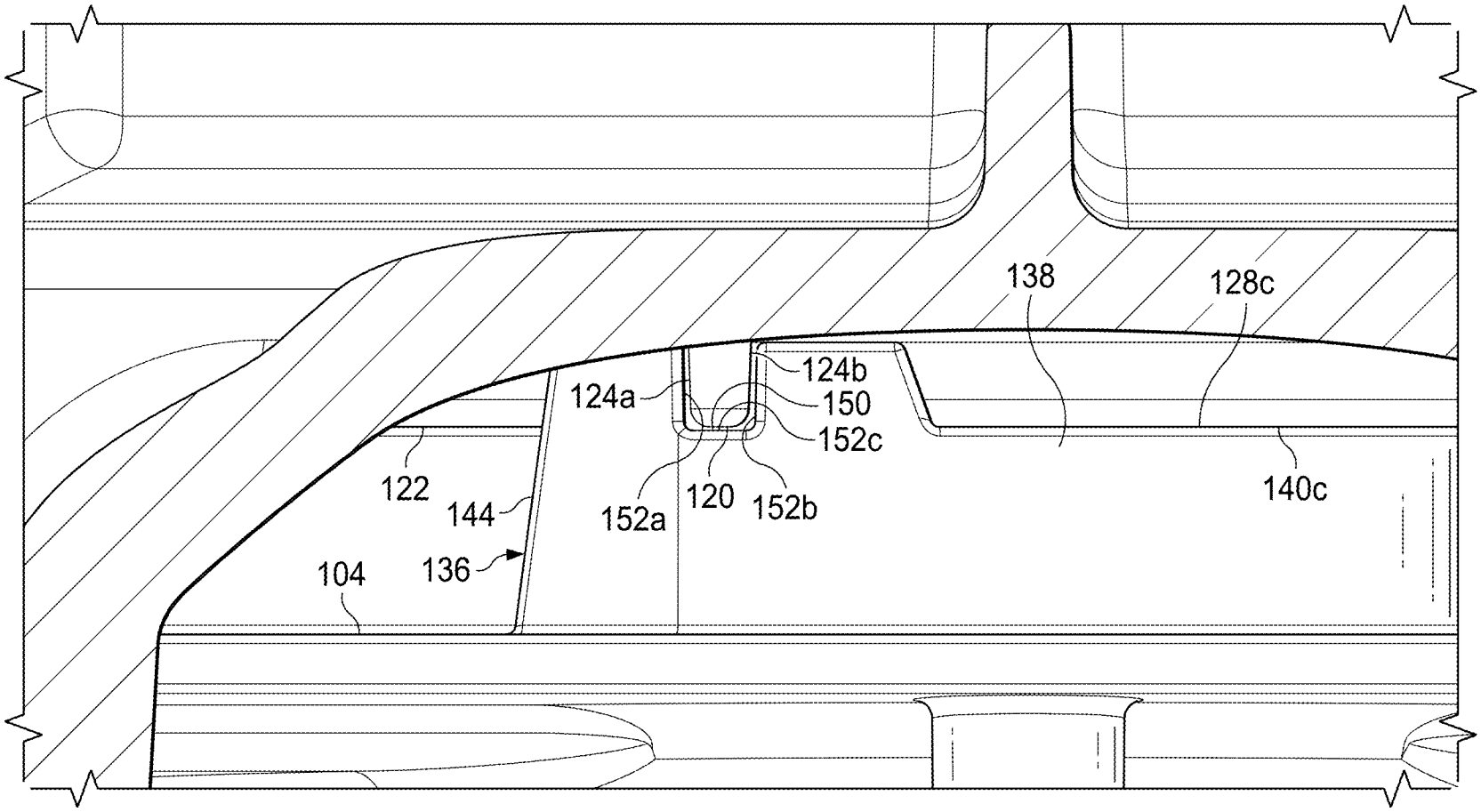
FIG. 20 is a partial top cutaway view of the pump of FIG. 1.
Figure 21:
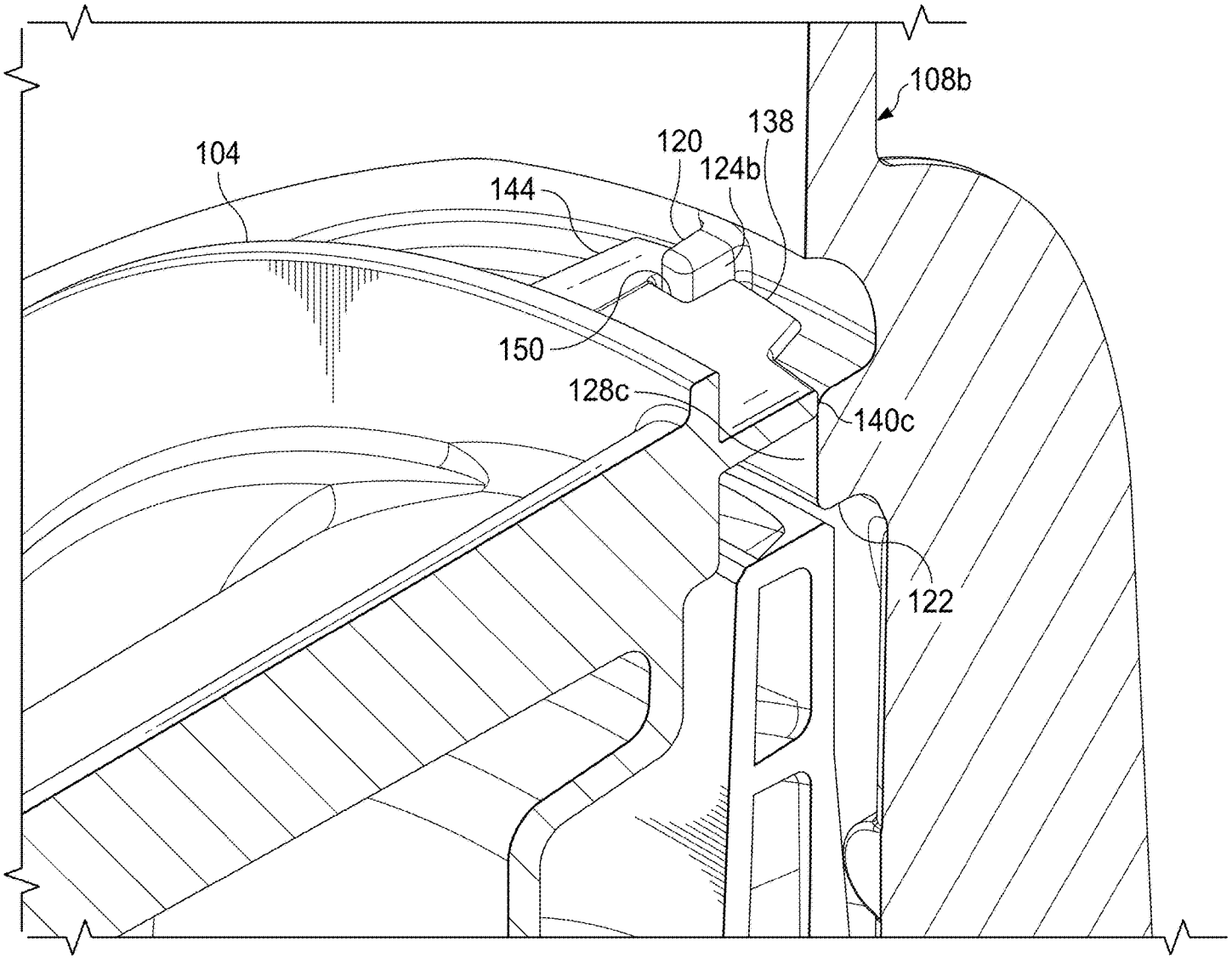
FIG. 21 is a partial front left isometric section view of the pump of FIG. 1. taken along line 3-3 of FIG. 1.
Figure 22:
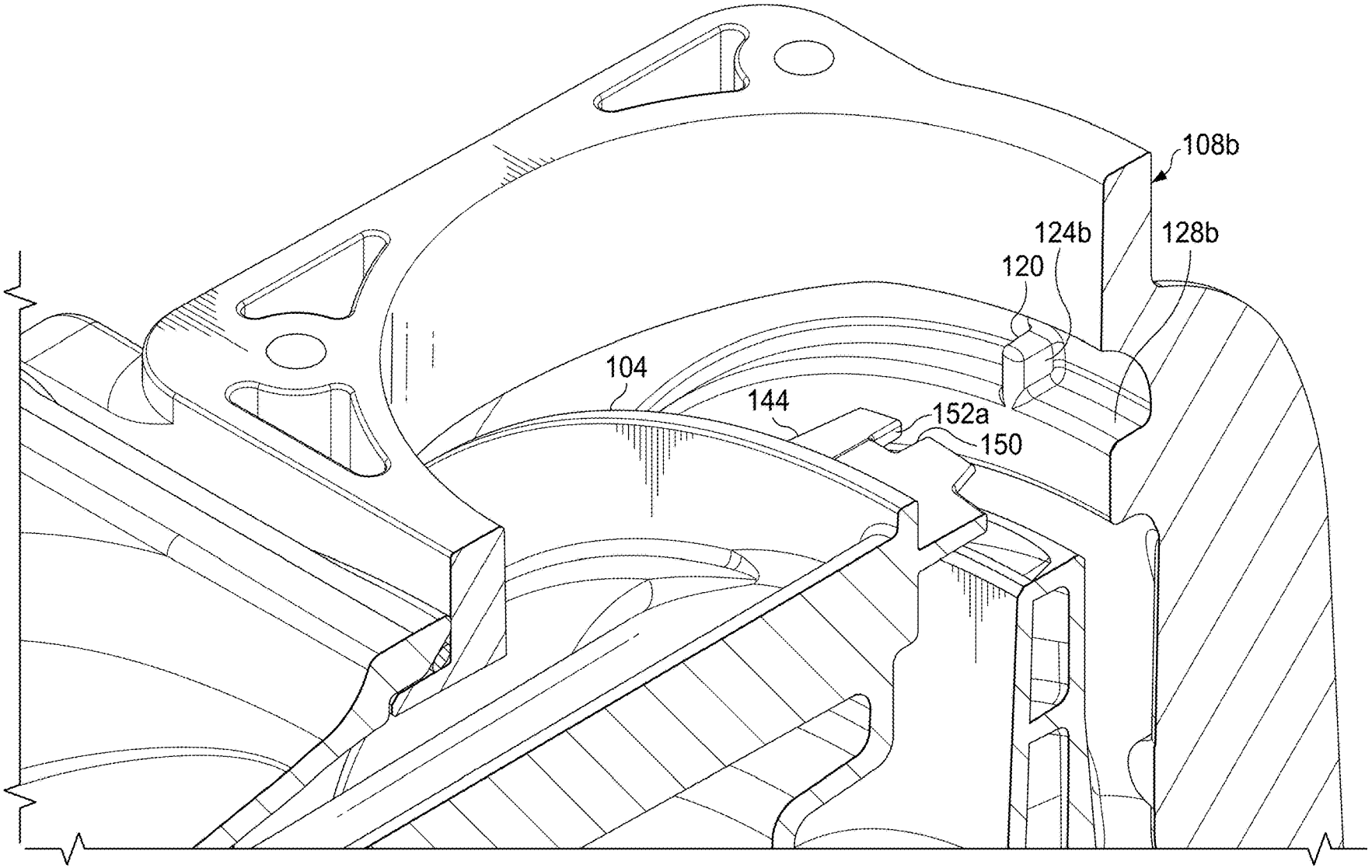
FIG. 22 is an exploded partial isometric section view of the pump of FIG. 1 taken along line 3-3 of FIG. 1.
Figure 23:
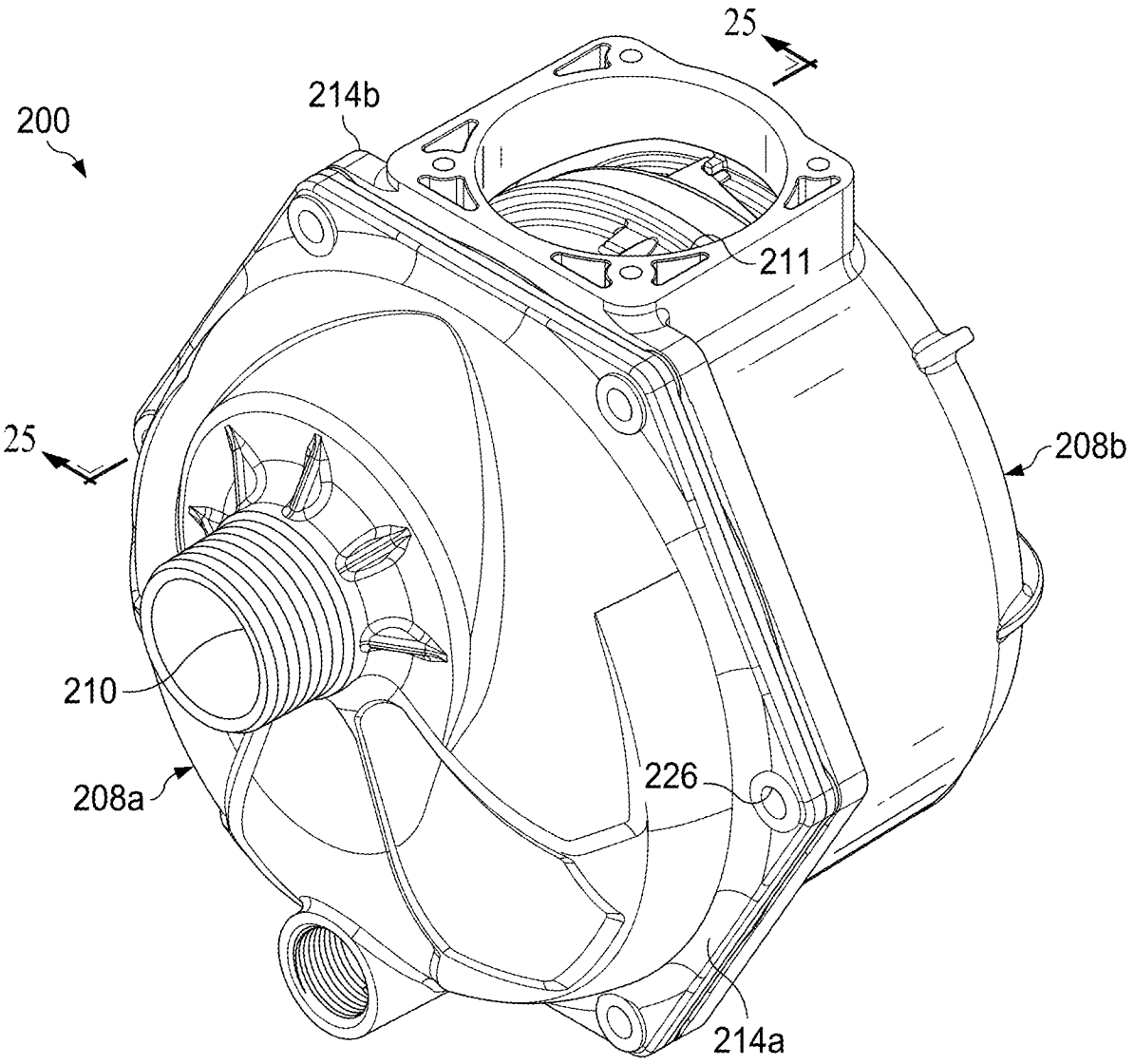
FIG. 23 is a front left isometric view of a pump according to another embodiment.
Figure 24:
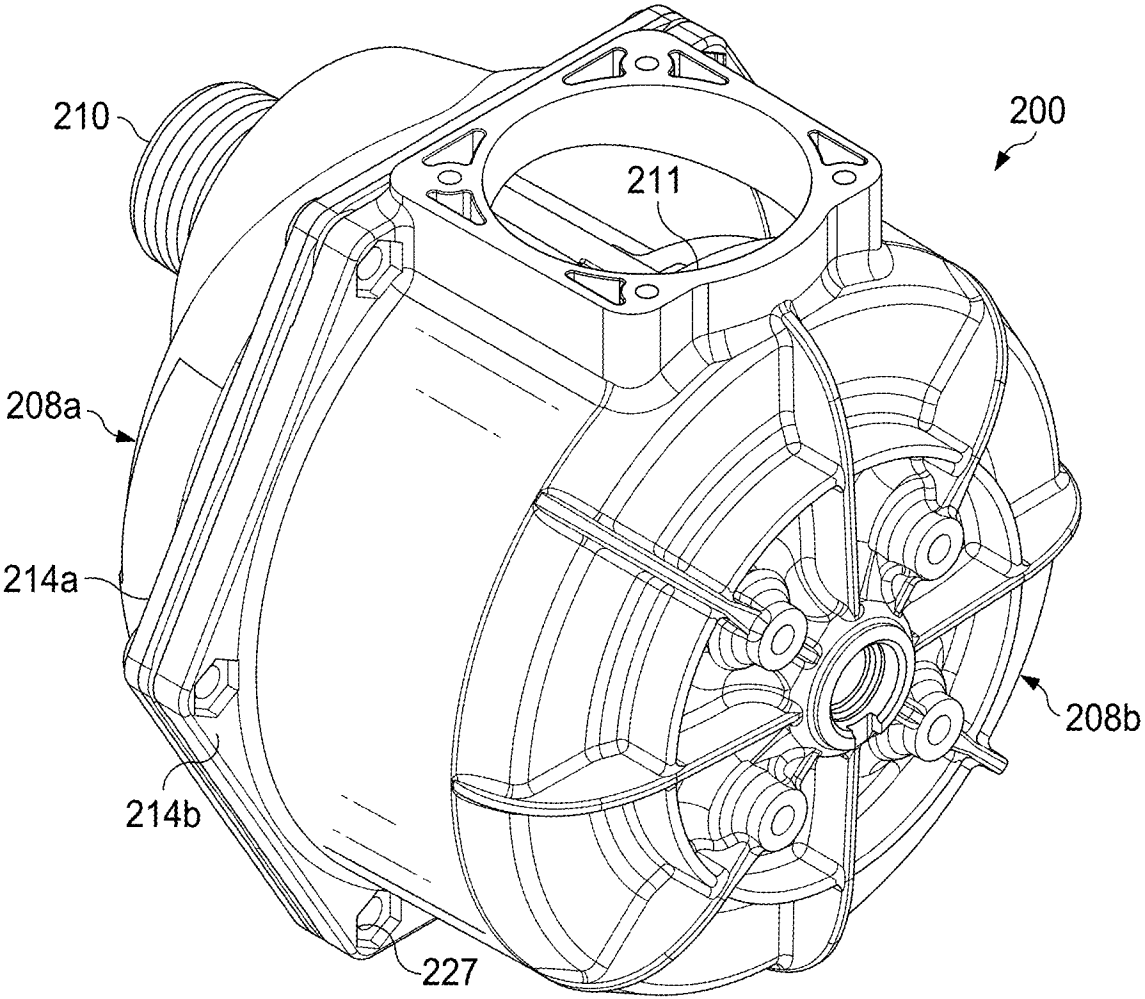
FIG. 24 is a rear left isometric view of the pump of FIG. 23.
Figure 25:
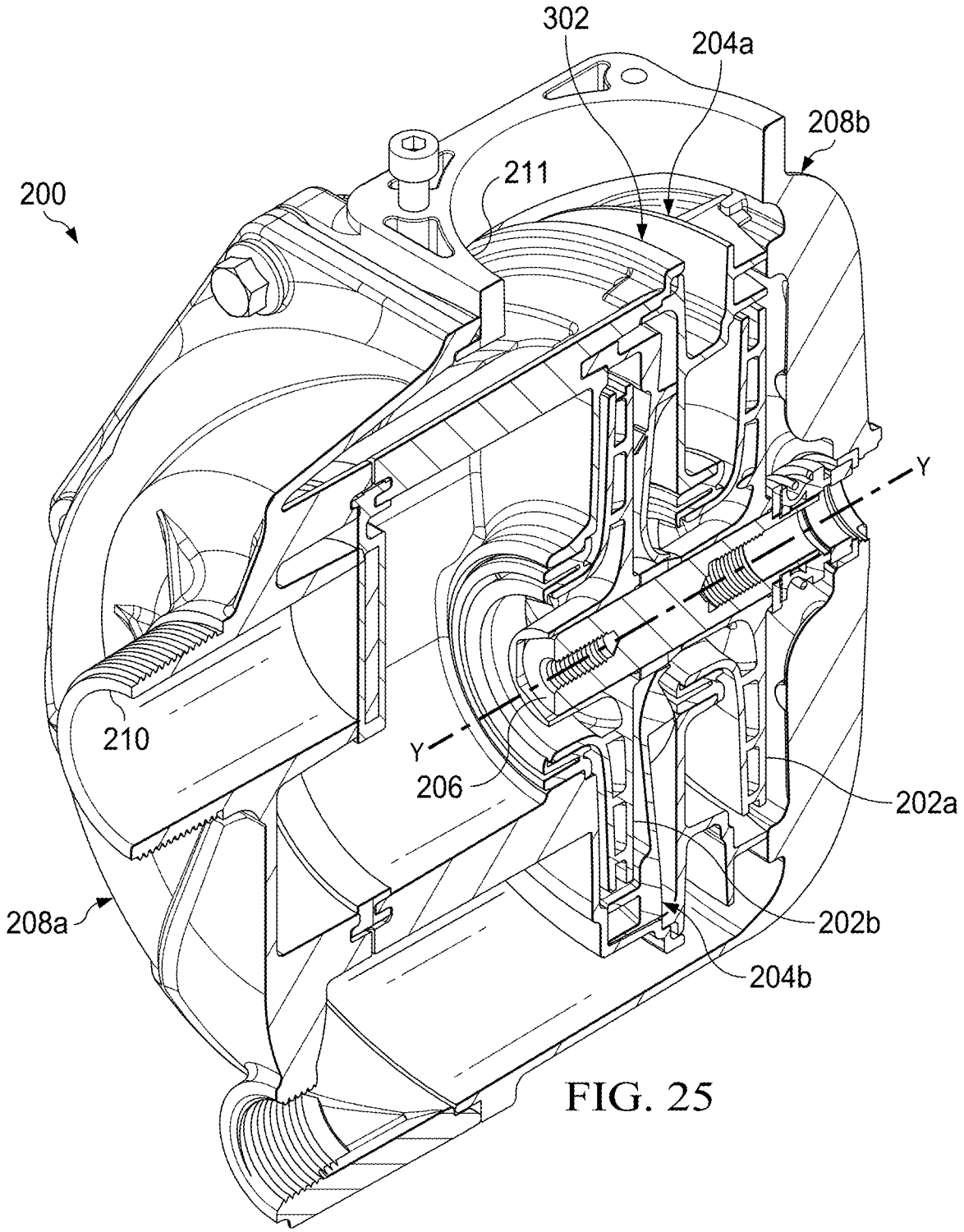
FIG. 25 is an isometric section view of the pump of FIG. 23 taken along line 25-25 of FIG. 23.
Figure 26:
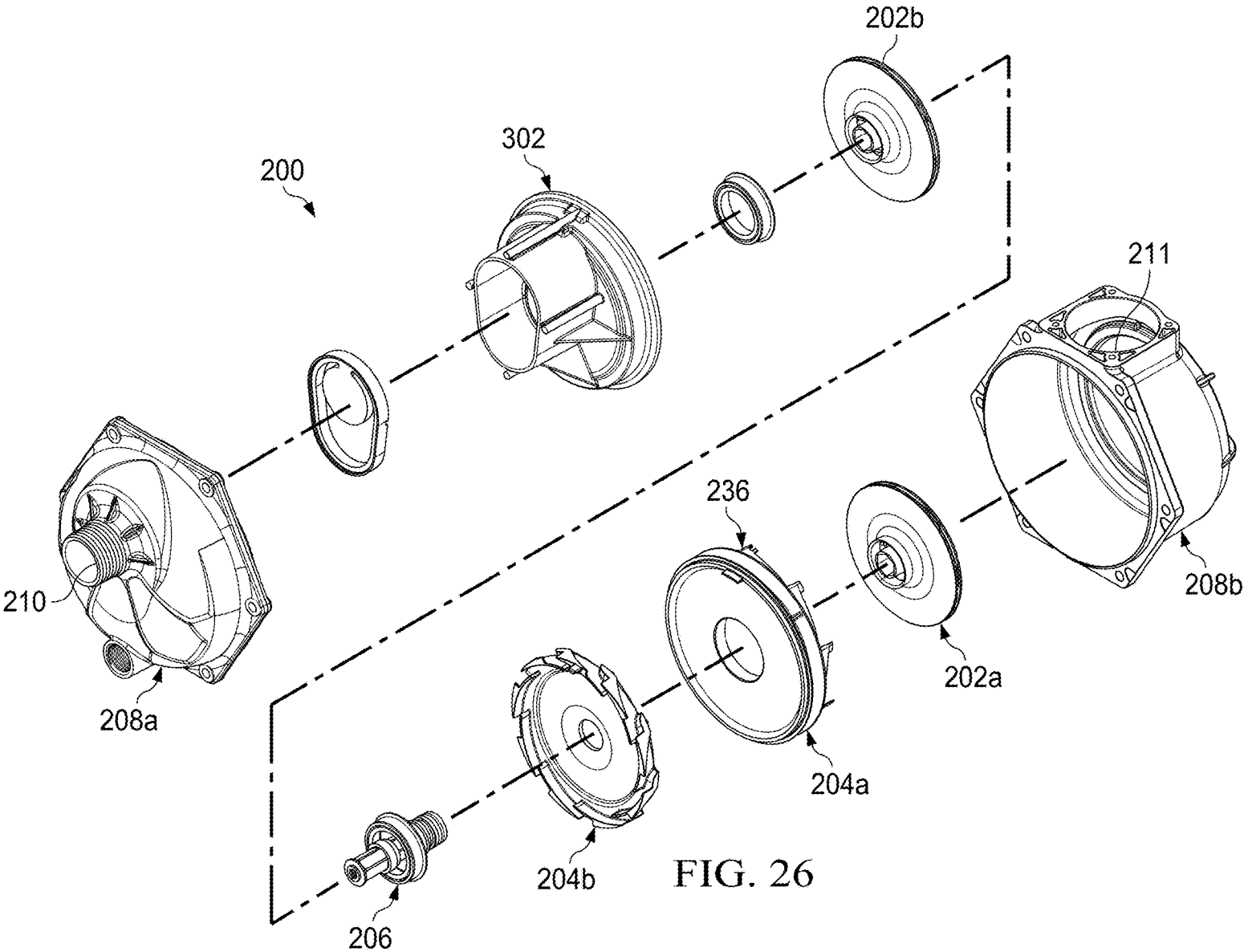
FIG. 26 is an exploded front left isometric view of the pump of FIG. 23.
Figure 27:
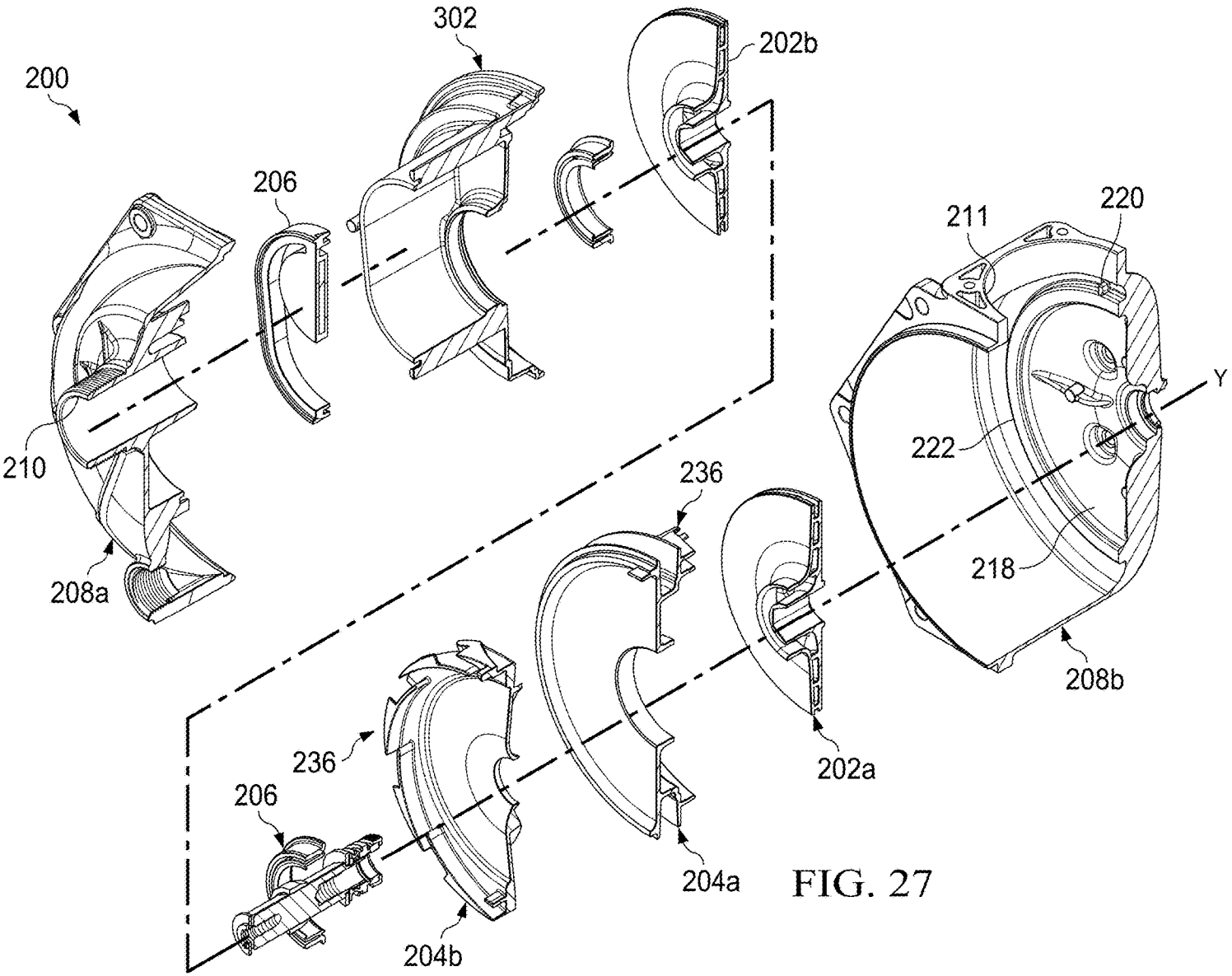
FIG. 27 is an exploded section view of the pump of FIG. 23 taken along line 25-25 of FIG. 23.
Figure 28:
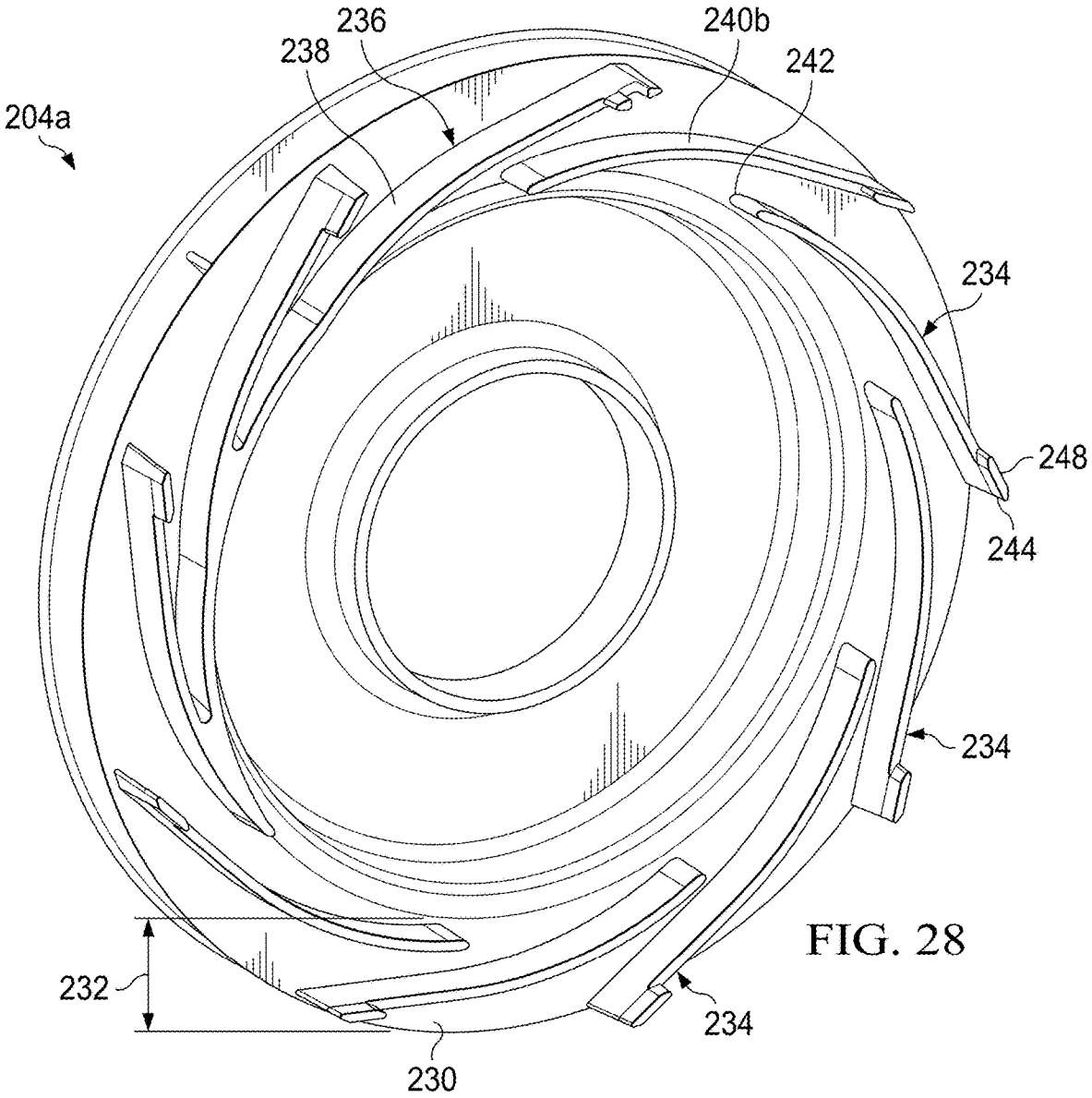
FIG. 28 is a rear left isometric view of a first diffuser of the pump of FIG. 23.
Figure 29:
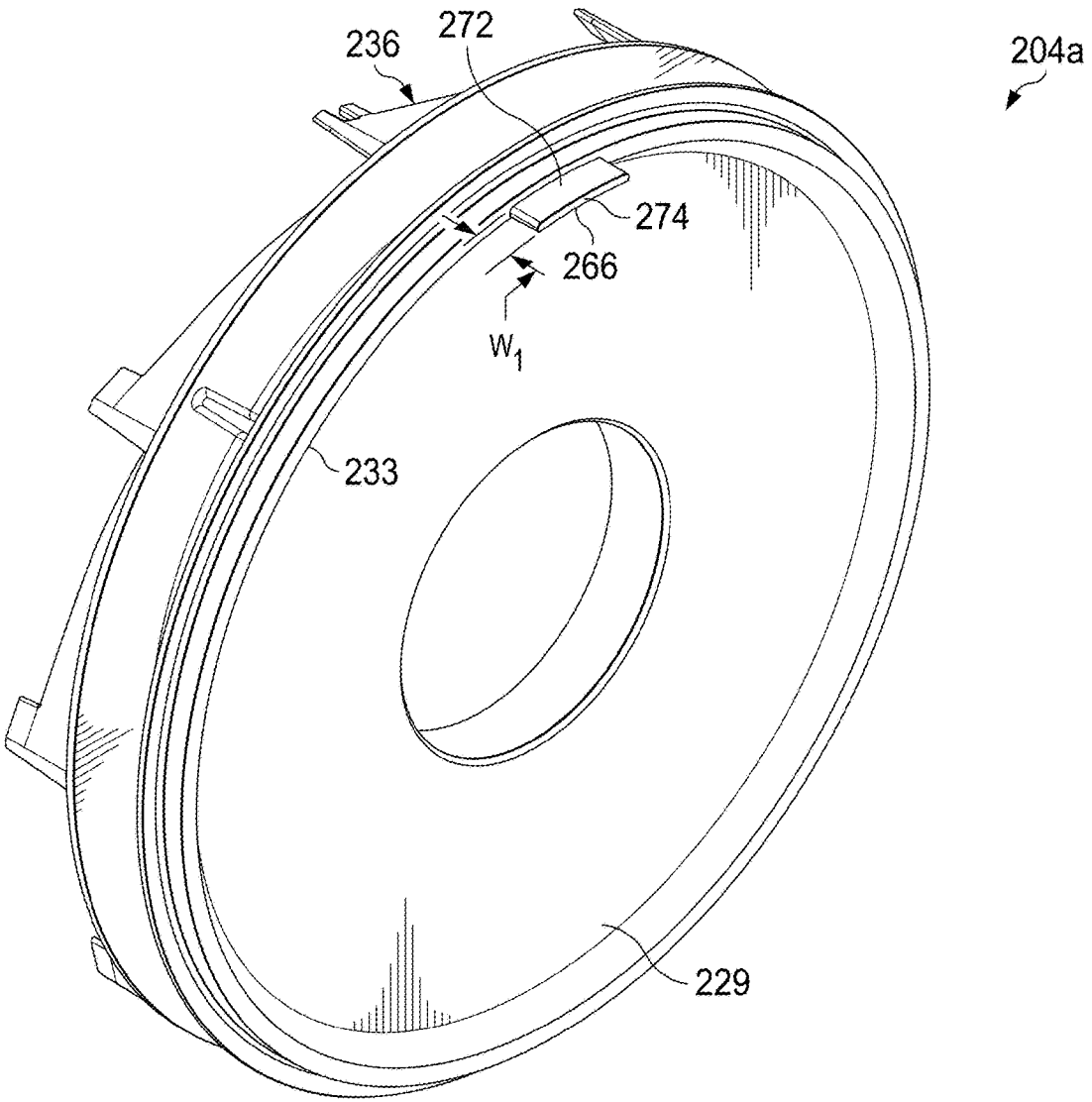
FIG. 29 is a front right isometric view of the first diffuser of FIG. 28.
Figure 30:
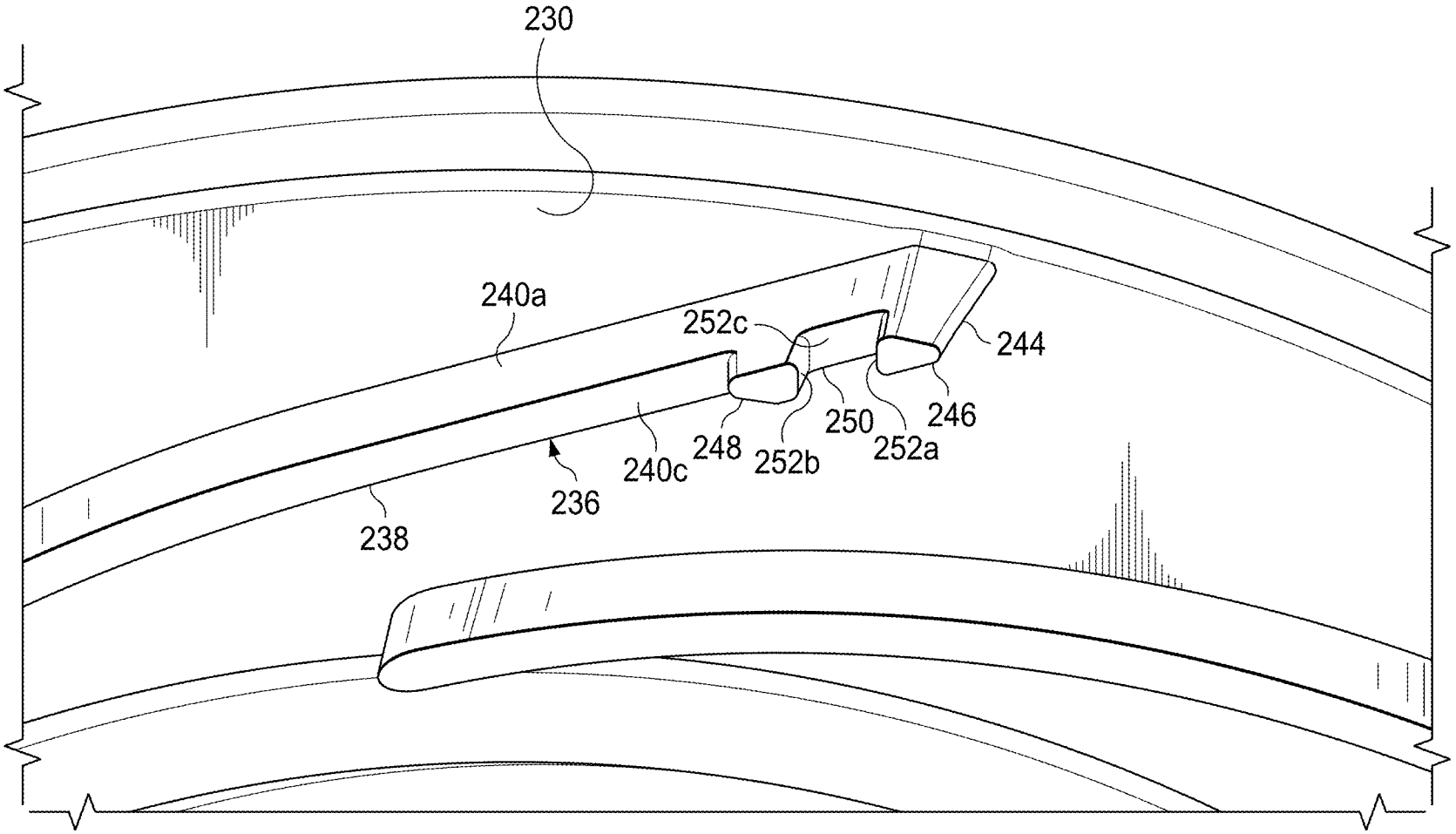
FIG. 30 is a partial rear top isometric view of the first diffuser of FIG. 28.
Figure 31:
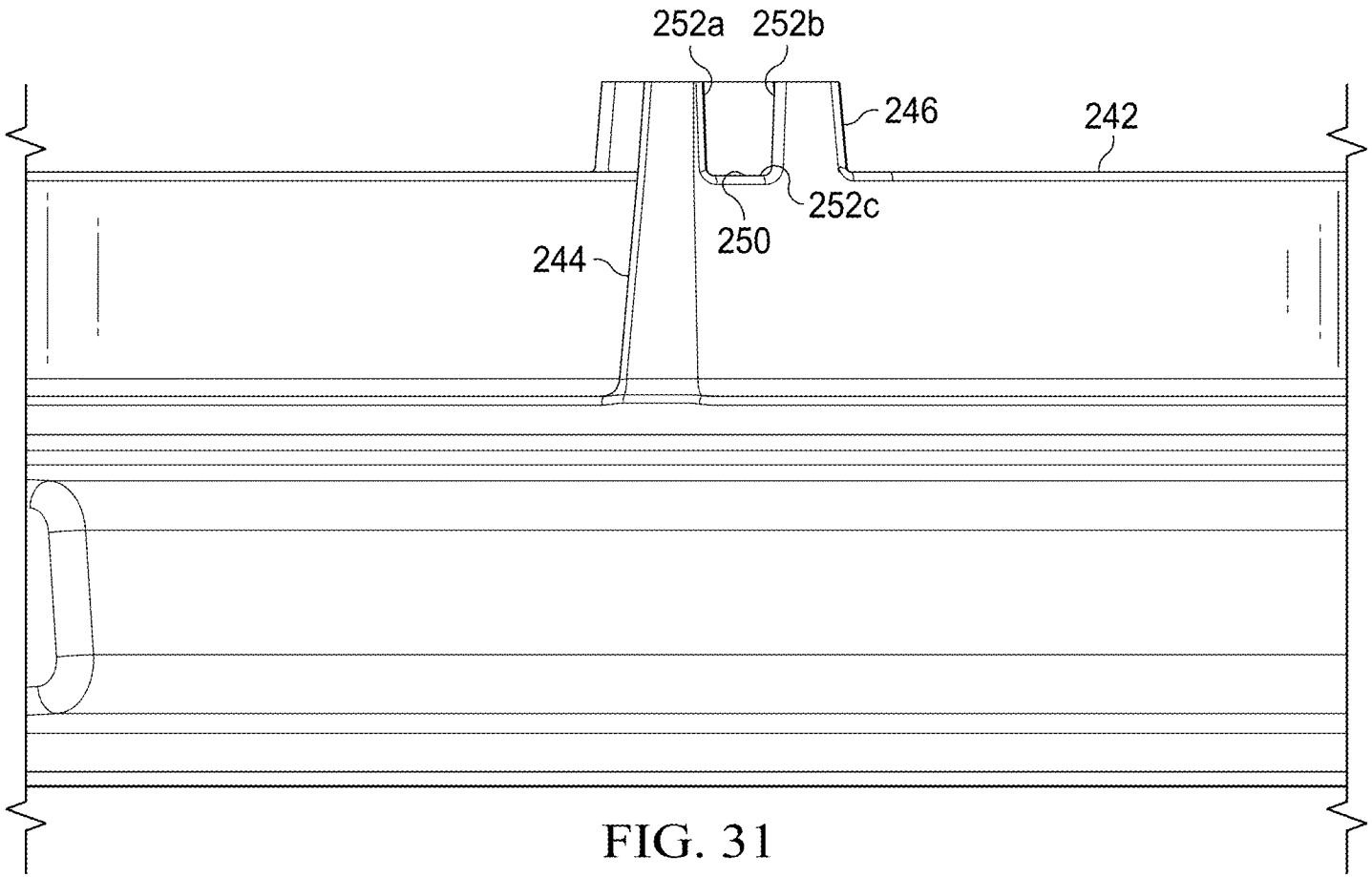
FIG. 31 is a partial top view of the first diffuser of FIG. 28.
Figure 32:
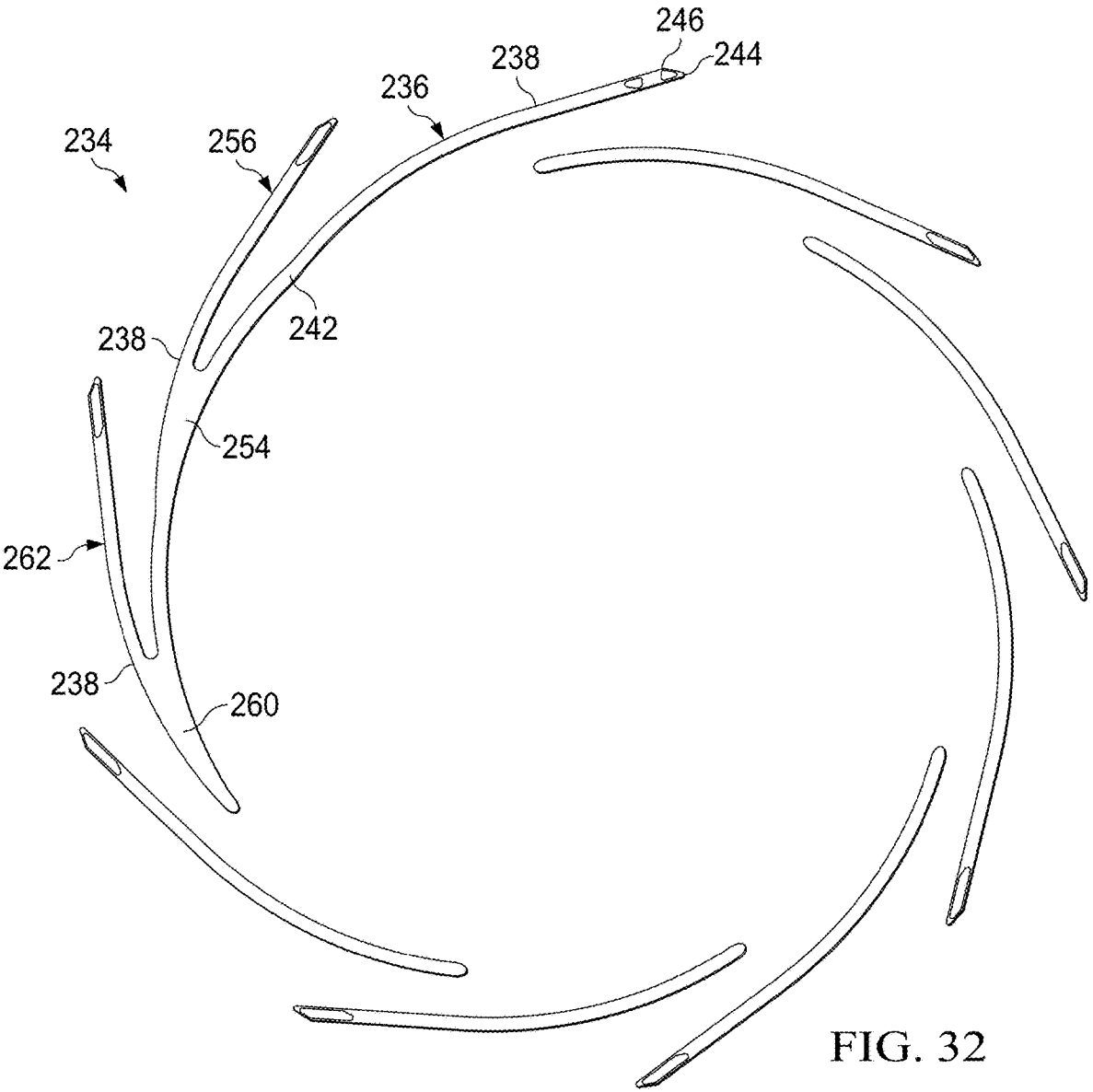
FIG. 32 is a rear view of a plurality of vanes of the first diffuser of FIG. 28.

Further, as shown in FIG. 20, when the first diffuser 104 is seated against the outlet housing 108*b*, the rear surface 140*c* of each vane body 138 contacts the front surface 128*c* of the alignment collar 122. In some forms, the alignment lug 120 is further sized and shaped such that when the rear surface 140*c* of each vane body 138 contacts the front surface 128*c* of the alignment collar 122, the alignment lug 120 does not make contact with the third inner surface 152*c* of the notch 150. Accordingly, when the first diffuser 104 is properly positioned so that the alignment lug 120 is received within the notch 150, the first diffuser 104 can be rotated slightly clockwise such that the first side surface 124*a* of the alignment lug 120 contacts the first inner surface 152*a* of the notch 150 and the first diffuser 104 can be rotated slightly counterclockwise such that the second side surface 124*b* of the alignment lug 120 contacts the second inner surface 152*b* of the notch 150.

In this way, after the first diffuser 104 is seated against the outlet housing 108*b*, a pump assembler can slightly rotationally jostle the first diffuser 104, and the pump assembler will be able to feel via the contact between the notch 150 and the alignment lug 120 that the first diffuser 104 is in the proper position. Further, the alignment lug 120 and the notch 150 provide an effective anti-rotation mechanism that prevents the first diffuser 104 from rotating in response to the circumferential forces of fluid flow in the pump during operation. One benefit provided herein is that the anti-rotation mechanism requires only one point of rotational contact, e.g., one of the first side surface 124*a* of the alignment lug 120 contacting the first inner surface 152*a* of the notch 150 or the second side surface 124*b* of the alignment lug 120 contacting the second inner surface 152*b* of the notch 150. The first vane confluence region 154 and/or the second vane confluence region 160 can help support the first vane 136 given that the notch 150 of the first vane 136 will be the only rotational point of contact between the outlet housing 108*b* and the first diffuser 104. Also, the alignment lug 120 is positioned on the inner wall 118 of the outlet housing 108*b* such that the interaction between the alignment lug 120 and the notch 150 can be seen by the pump assembler through the outlet member 111 during assembly, thus ensuring that the wet end 100 of the pump is properly assembled, and the anti-rotation mechanism is in effect.

As an additional alignment mechanism, the radial alignment surfaces 148 (see FIG. 10) of the vane heads 146 are configured to surround, and be slightly offset from, the outer surface 128*b* (see FIG. 16) of the alignment collar 122 when the first diffuser 104 is properly positioned against the outlet housing 108*b*. Accordingly, when the first diffuser 104 is being placed against the outlet housing 108*b*, the radial alignment surfaces 148 help the pump assembler properly center the first diffuser 104 over the alignment collar 122 to prevent accidental lateral movement of the first diffuser 104 during assembly.

FIGS. 23-27 illustrate a second embodiment of a wet end 200 of a multi-stage pump. The wet end 200 of the multi-stage pump can include a first impeller 202*a*, a second impeller 202*b*, a first diffuser 204*a*, a second diffuser 204*b*, a volute housing 302, a drive shaft 206, and a housing including an inlet housing 208*a* and an outlet housing 208*b*. The multi-stage pump can further include a dry end with a motor (not shown) and a motor drive (not shown) that are configured to drive the drive shaft 206. Here, the inlet housing 208*a* includes an inlet member 210 and the outlet housing 208*b* includes an outlet member 211. When properly assembled, the inlet housing 208*a*, the outlet housing 208*b*, the first impeller 202*a*, the second impeller 202*b*, the first diffuser 204*a*, the second diffuser 204*b*, and the volute housing 302 are axially aligned along an axis Y-Y (see FIG. 25) that extends through the drive shaft 206. In particular, the first impeller 202*a*, the second impeller 202*b*, the first diffuser 204*a*, the second diffuser 204*b*, and the drive shaft 206 are concentrically aligned along the axis Y-Y. The outlet housing 208*b* forms an interior volume into which the first impeller 202*a*, the second impeller 202*b*, the first diffuser 204*a*, and the second diffuser 204*b* are received. Here, the pump components are arranged from back to front in the following order: the outlet housing 208*b*, the first impeller 202*a*, the first diffuser 204*a*, the second diffuser 204*b*, the second impeller 202*b*, the volute housing 302, and the inlet housing 208*a*.

FIGS. 28-32 illustrate the first diffuser 204*a* and aspects thereof in detail. The first diffuser 204*a* consists of a front face 229 and a rear face 230 and can be provided in the form of a disc. The rear face 230 of the first diffuser 204*a* of the wet end 200 comprises substantially similar features to the rear face 130 of the first diffuser 104 of the wet end 100. Accordingly, the description of the rear face 130 of the first diffuser 104 and its corresponding components above is incorporated by reference herein with respect to the rear face 230 of the first diffuser 204*a* and its corresponding components. For example, the rear face 230 of the first diffuser 204*a* similarly includes an outer circumferential portion 232, a plurality of vanes 234 each including a vane body 238, a leading edge 242, and a trailing edge 244 with a vane head 246. Further, each vane head 246 includes an inner radial alignment surface 248. Each vane body 238 includes a rear surface 240*c*, an inner surface 240*b*, and an outer surface 240*a*. The plurality of vanes 234 includes a first vane 236 having a notch 250, the notch 250 including first, second, and third inner surface 252*a*, 252*b*, 252*c*, a second vane 256, a first vane confluence region 254, a third vane 262, and a second vane confluence region 260.

In contrast to the first diffuser 104, the first diffuser 204*a* can further include an alignment tab 266 that protrudes outward from the front face 229 of the first diffuser 204*a* by a width dimension W1. In some forms, the front face 229 further includes a circumferential protrusion 233, and the alignment tab 266 is positioned on the circumferential protrusion 233. The alignment tab 266 can include a top surface 272 and a front surface 274. In some forms, the alignment tab 266 includes an arched profile that follows the curvature of the outer circumference of the first diffuser 204*a*. Further, the alignment tab 266 can be positioned adjacent to the outer circumference of the front face 229.

Figure 33:
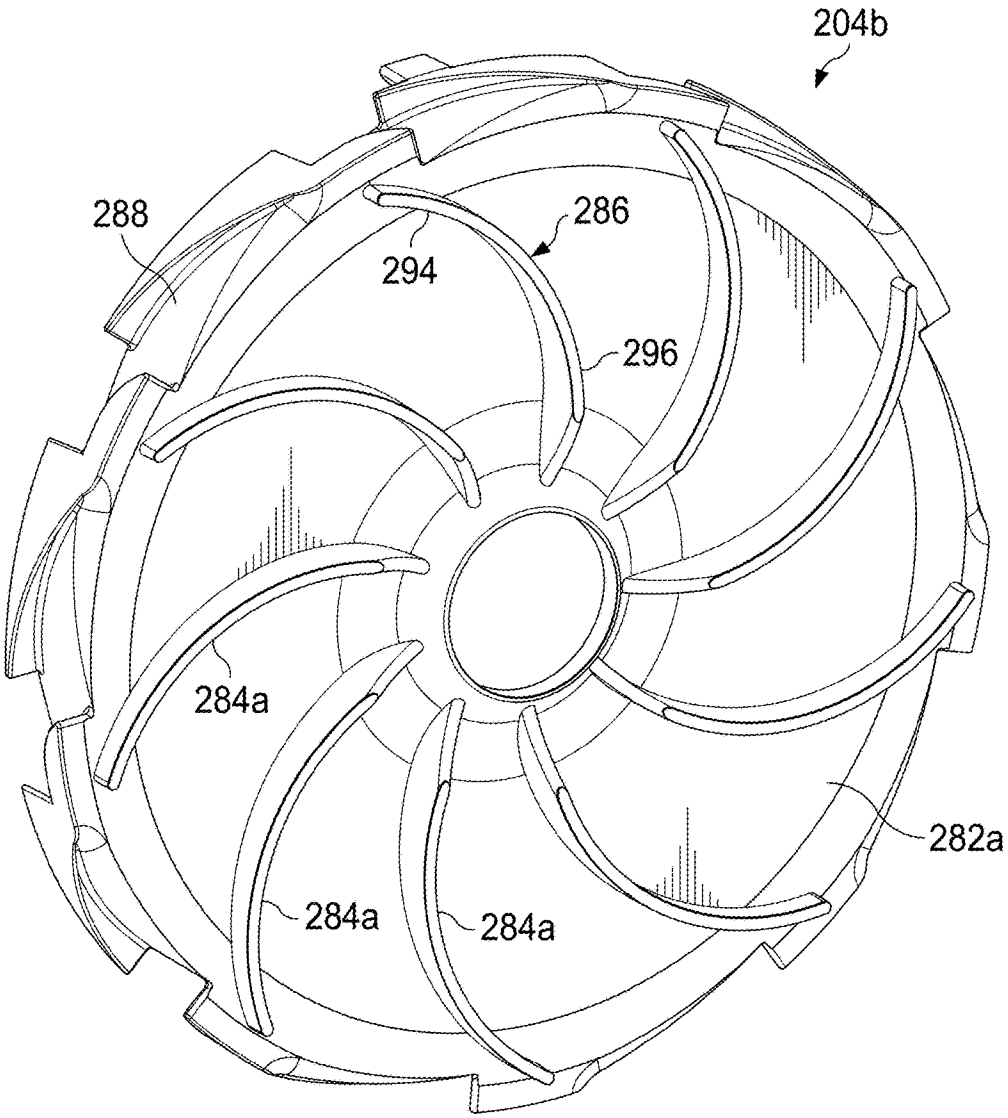
FIG. 33 is a rear left isometric view of a second diffuser of the pump of FIG. 23.
Figure 34:
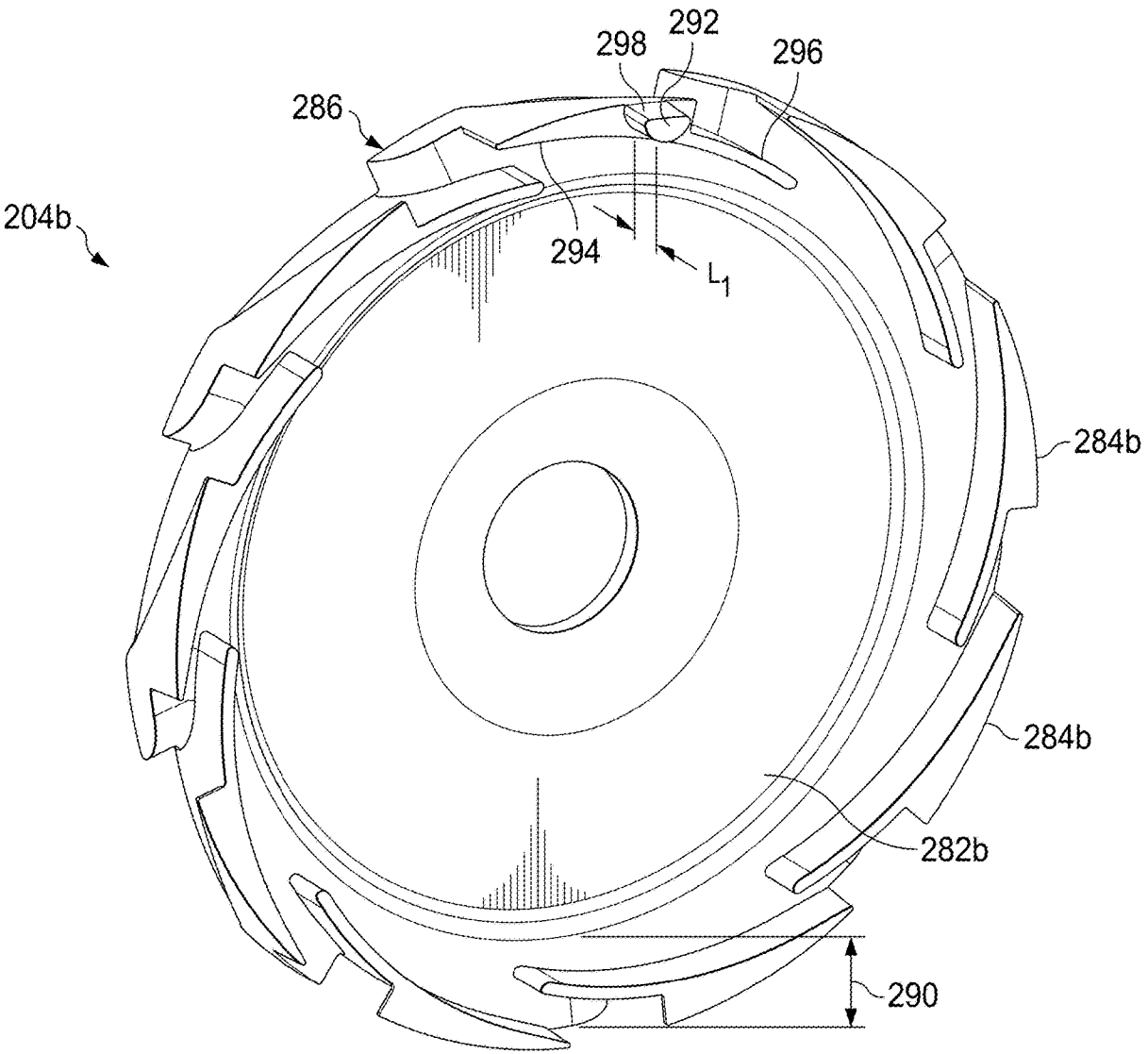
FIG. 34 is a front right isometric view of the second diffuser of FIG. 33.

FIGS. 33 and 34 illustrate the second diffuser 204*b* and aspects thereof in detail. The second diffuser 204*b* includes a rear face 282*a*, a front face 282*b*, and an outer surface 288. In some forms, the second diffuser 204*b* is provided in the form of a disc. On the rear face 282*a*, the second diffuser 204*b* includes a plurality of rear vanes 284*a*. Further, the front face 282*b* includes a plurality of front vanes 284*b* that is arranged on an outer circumferential region 290 of the second diffuser 204*b*. In some forms, the plurality of front vanes 284*b* extend toward and form part of the outer circumference of the second diffuser 204*b*. The plurality of front vanes 284*b* includes a first vane 286 with a vane head 294 and vane tail 296. The second diffuser 204*b* additionally includes an alignment post 292 that extends outward from the vane head 294 at a length L1, away from the front face 282*b*, and substantially parallel to the axis Y-Y (see FIG. 25). In some embodiments, the alignment post 292 is provided in another position on the outer circumferential region 290 or the first vane 286 and not on the vane head 294. In some embodiments, the alignment post 292 is provided in the form of a half-cylinder or truncated cylinder with a substantially flat surface 298.

Figure 35:
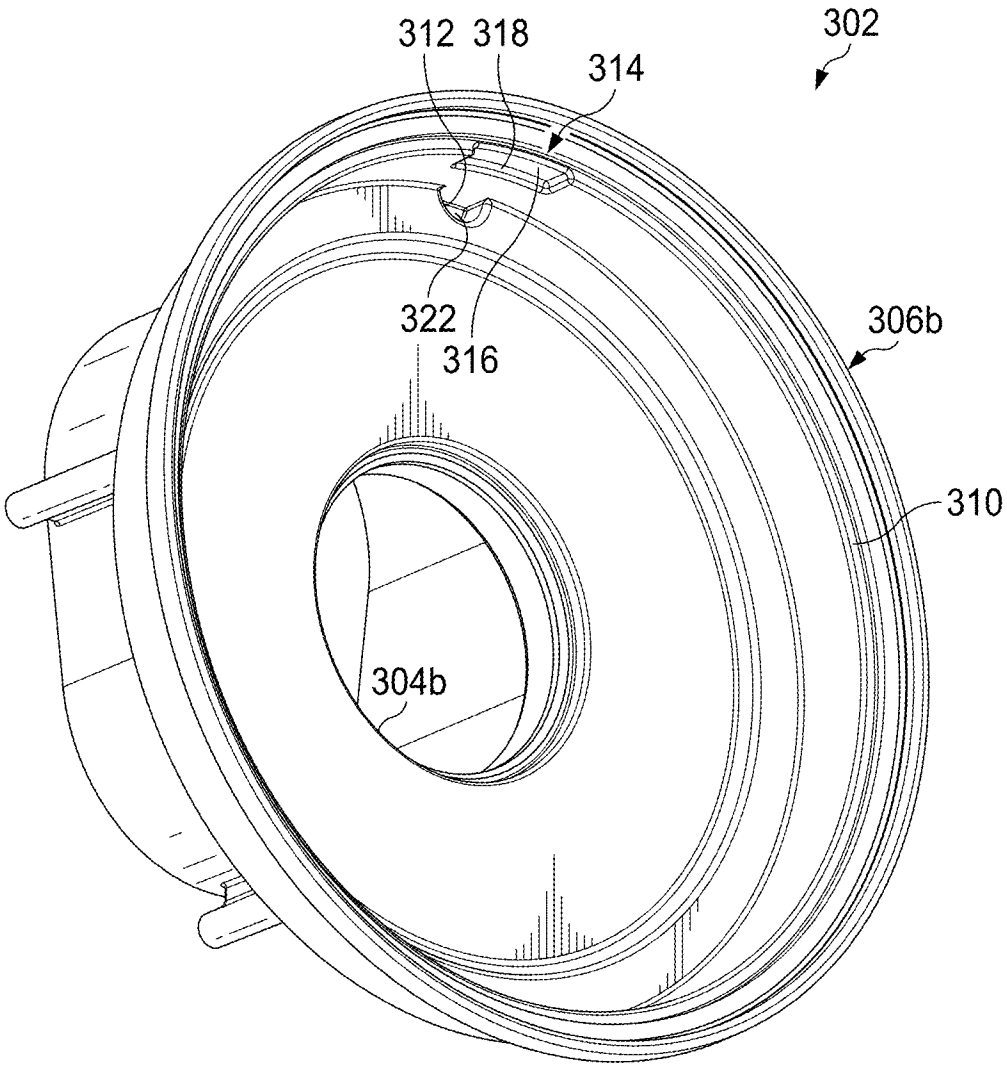
FIG. 35 is a rear left isometric view of a volute housing of the pump of FIG. 23.
Figure 36:
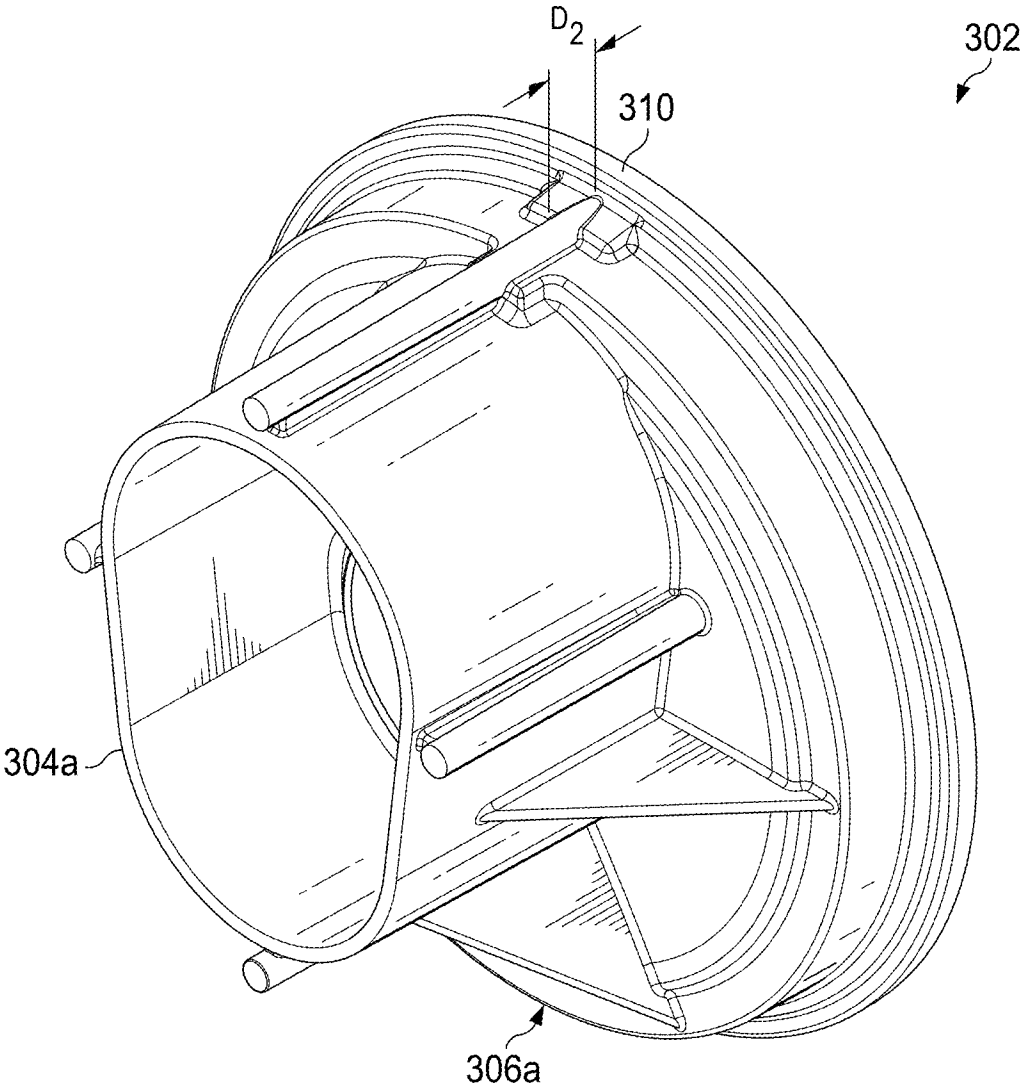
FIG. 36 is a front left isometric view of the volute housing of FIG. 35.

FIGS. 35 and 36 illustrate the volute housing 302 and aspects thereof in further detail. The volute housing 302 can include an inlet 304*a* positioned on a front portion 306*a* of the volute housing 302 and an outlet 304*b* positioned on a rear portion 306*b* of the volute housing 302. Further, the volute housing 302 includes a rim 310 extending around the outer circumference of the volute housing 302. The rim 310 includes a recessed portion 314 located adjacent to the outer circumference of the volute housing 302. The recessed portion 314 includes an inner surface 316 and a front wall 318 (see FIG. 35). The volute housing 302 can also include a blind hole 312 that is recessed into the rear portion 306*b* at a depth D2 (see FIG. 36). In some forms, the blind hole 312 is located adjacent to and vertically beneath the recessed portion 314 of the volute housing 302. The blind hole 312 can be provided in the form of a half-cylinder or truncated cylinder with a substantially flat surface 322. In particular, the flat surface 322 of the blind hole 312 is located at the top of the blind hole 312 adjacent to the recessed portion 314.

Figure 37:
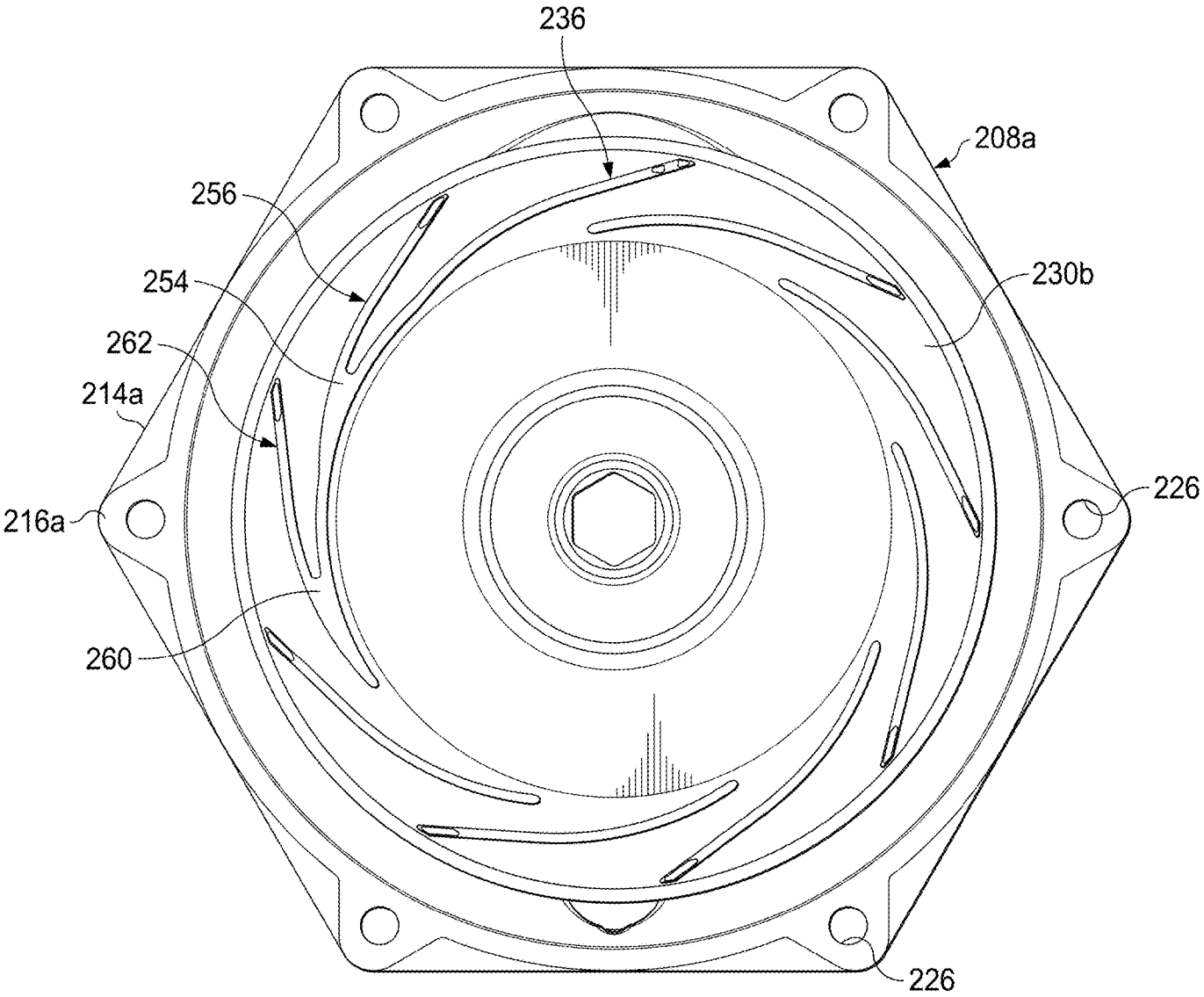
FIG. 37 is a front view of the first diffuser and an inlet housing of the pump of FIG. 23.

As shown in FIG. 37, the inlet housing 208*a* of the wet end 200 comprises substantially similar features to the inlet housing 108*a* of the wet end 100, and the description of the inlet housing 108*a* and its corresponding components is incorporated by reference herein with respect to the inlet housing 208*a* and its corresponding components. For example, the inlet housing 208*a* similarly includes an inlet housing flange 214*a* with an inlet housing flange surface 216*a*. The inlet housing flange 214*a* further includes a plurality of holes 226. In some forms, the inlet housing 208*a* includes a plurality of protruding portions on an inner surface (not shown) that are configured to mate with the front portion 306*a* of the volute housing 302.

Figure 38:
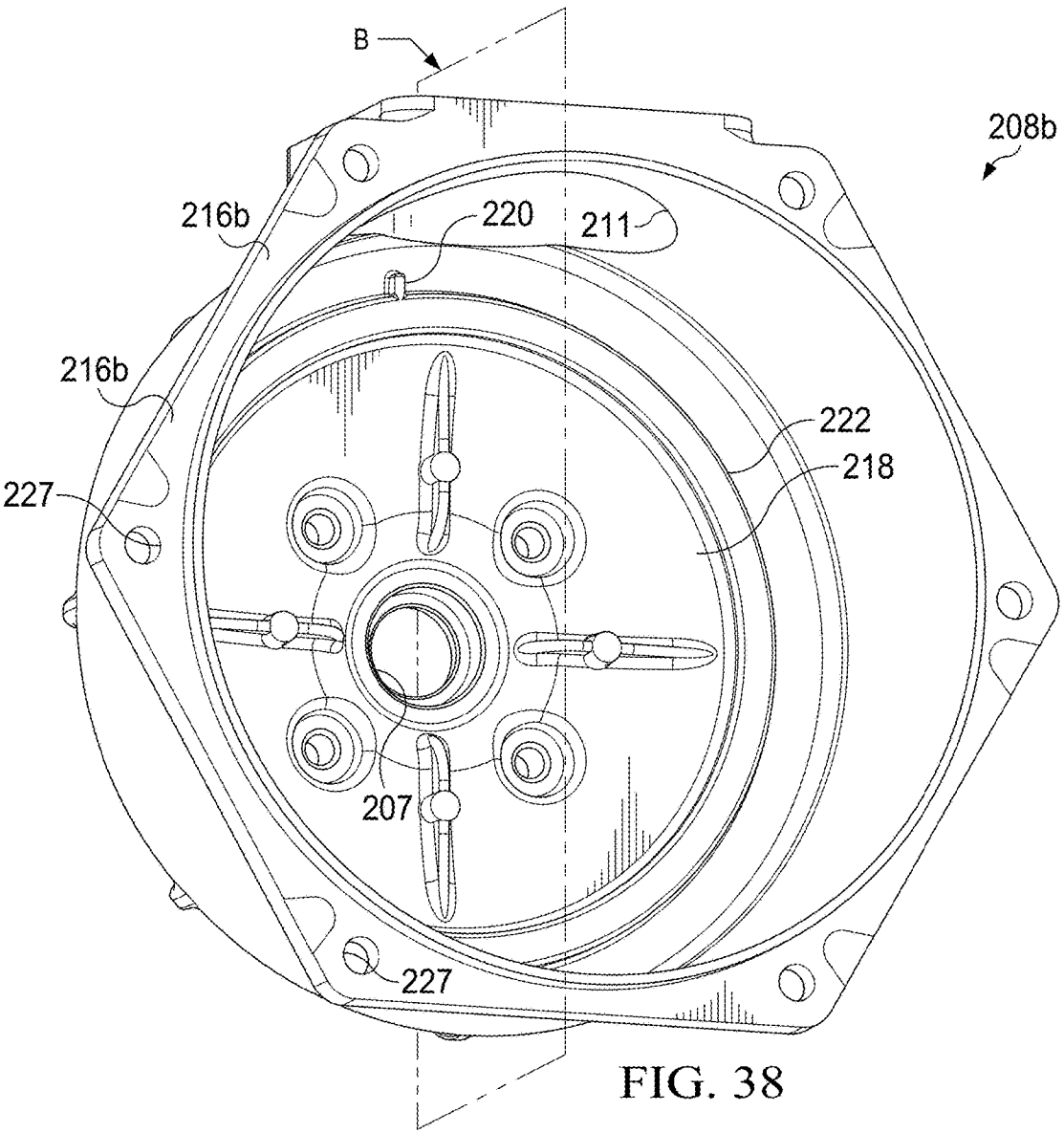
FIG. 38 is a front right isometric view of an outlet housing of the pump of FIG. 23.
Figure 39:
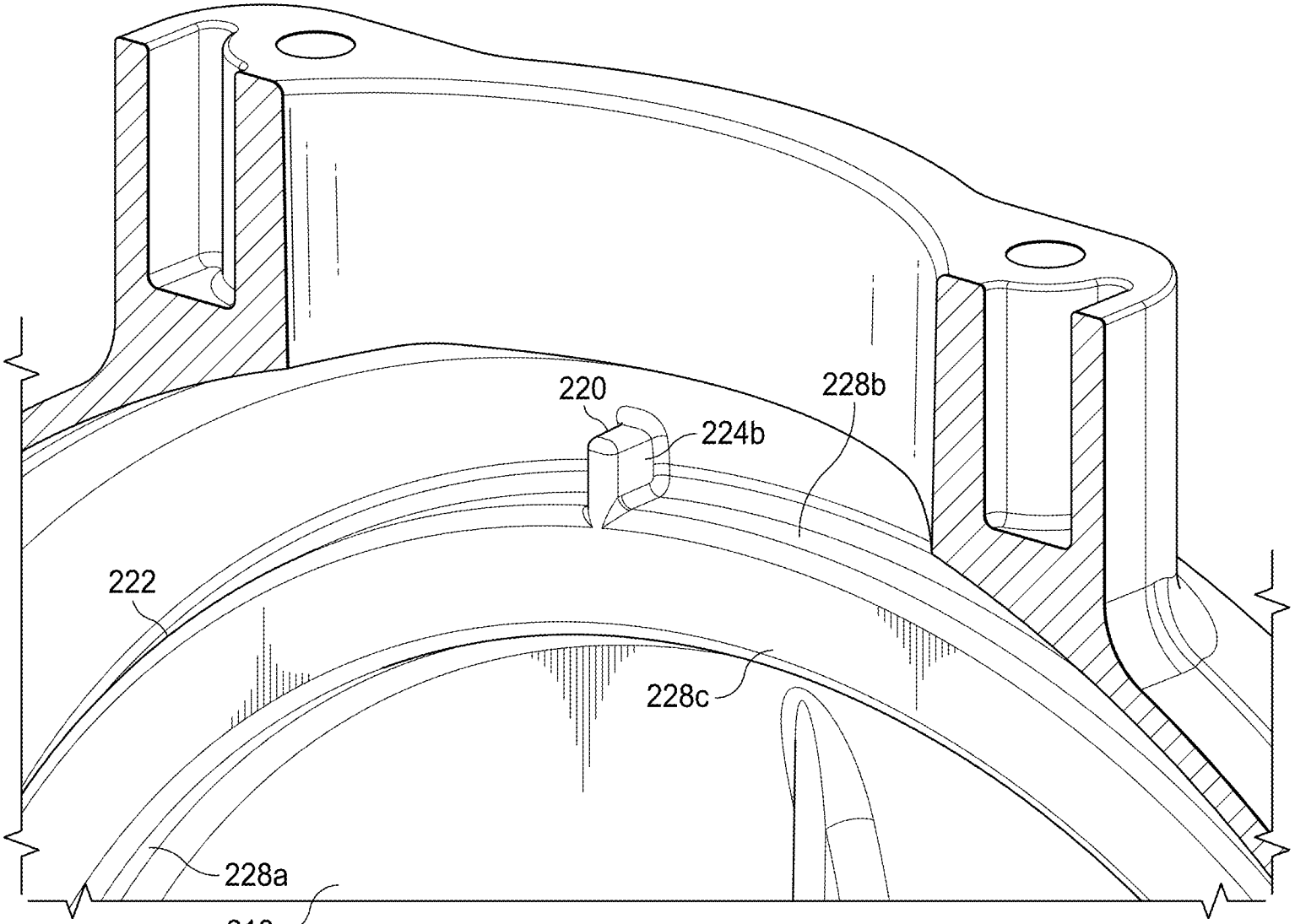
FIG. 39 is a partial front left isometric cutaway view of the outlet housing of FIG. 38.
Figure 40:
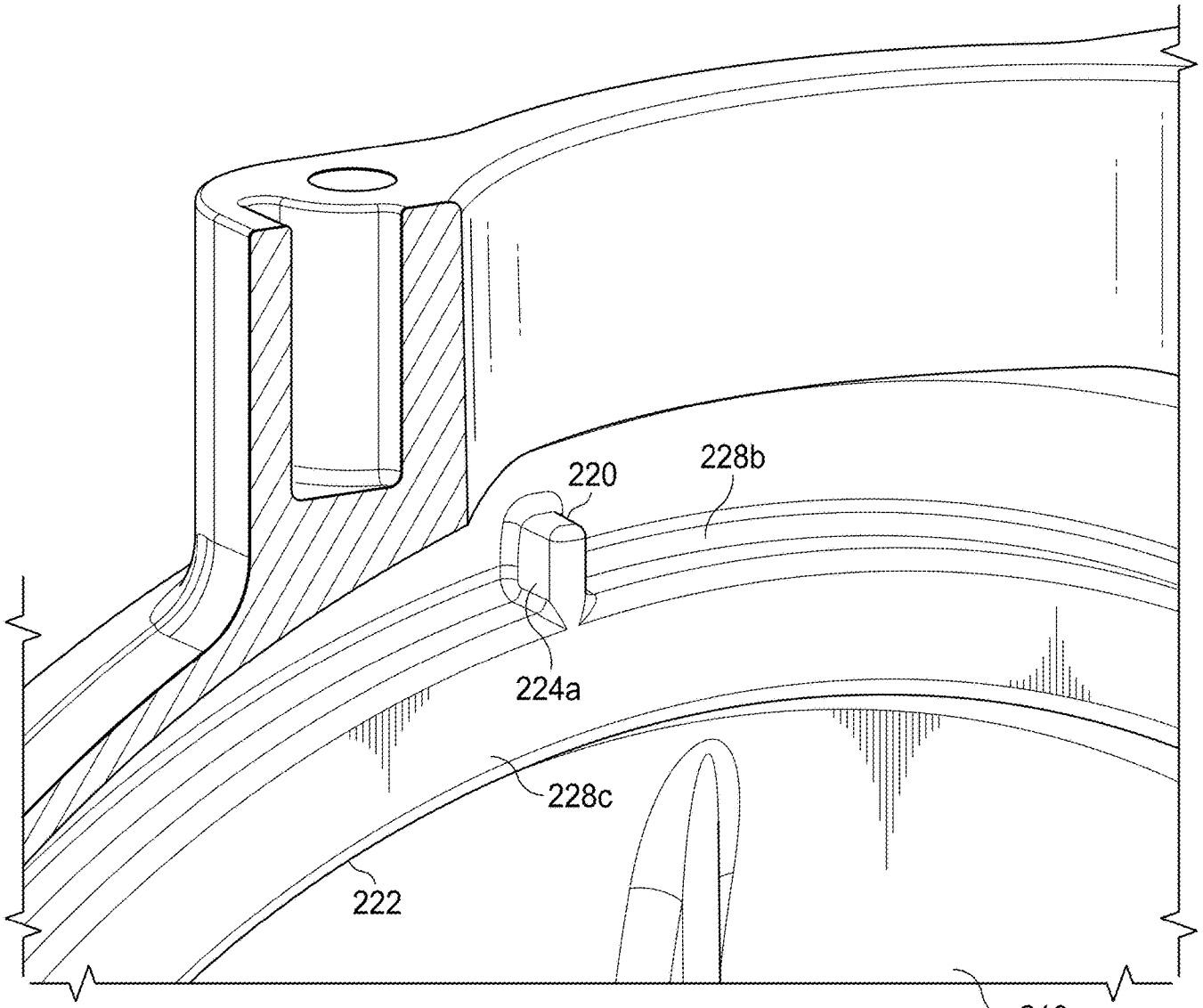
FIG. 40 is a partial front right isometric cutaway view of the outlet housing of FIG. 38.
Figure 41:
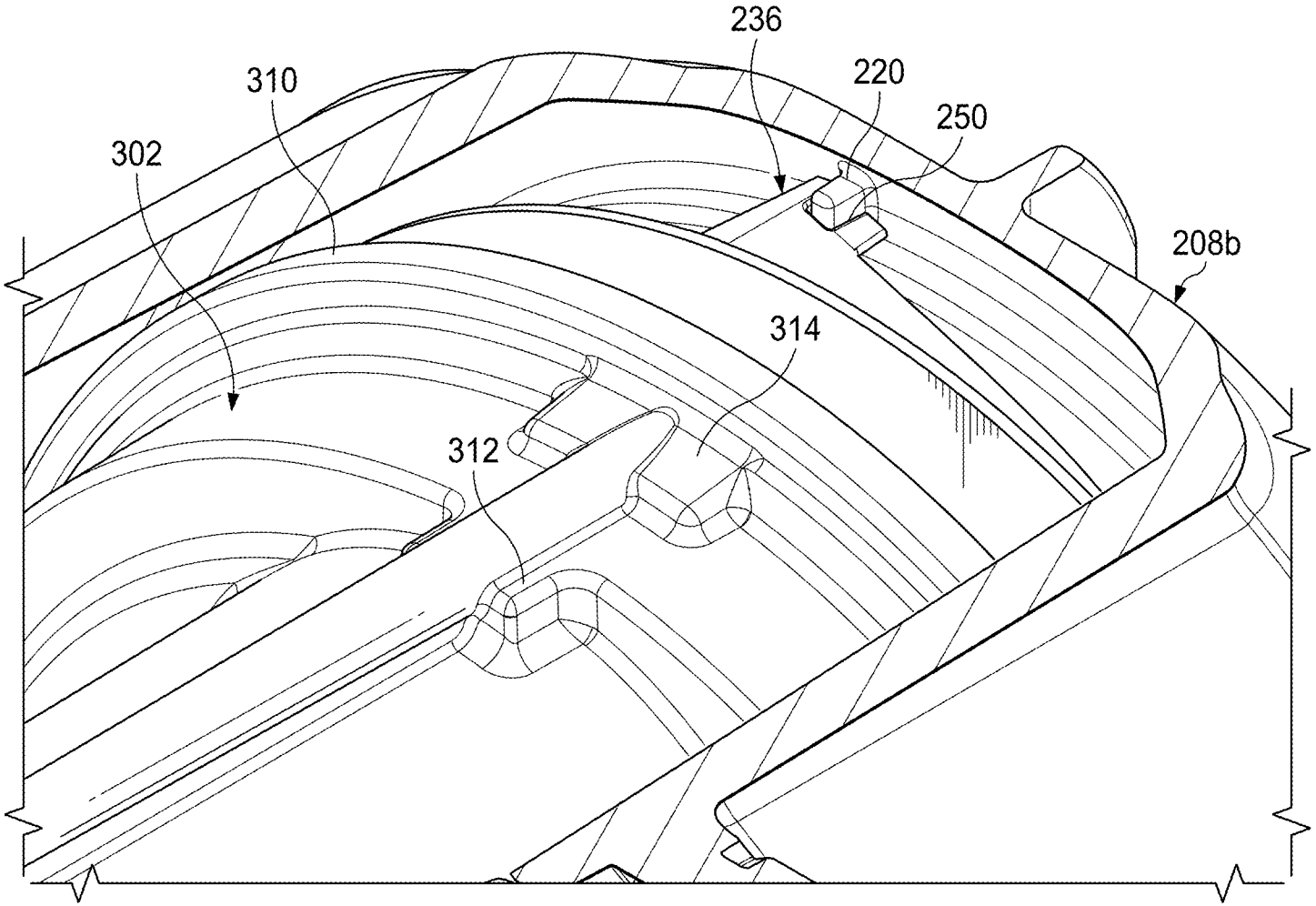
FIG. 41 is a partial front left isometric cutaway view of the pump of FIG. 23.
Figure 42:
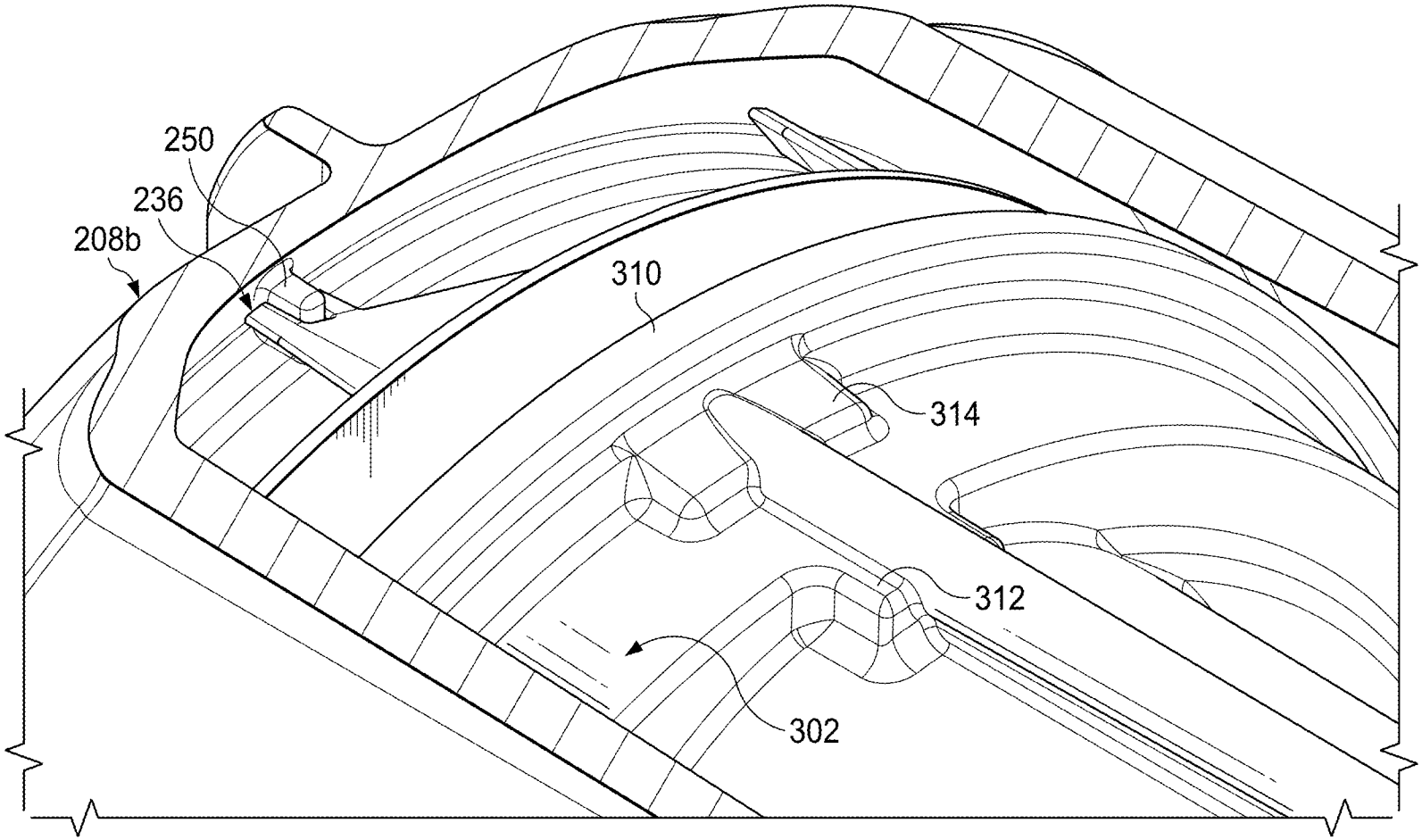
FIG. 42 is a partial front right isometric cutaway view of the pump of FIG. 23.
Figure 43:
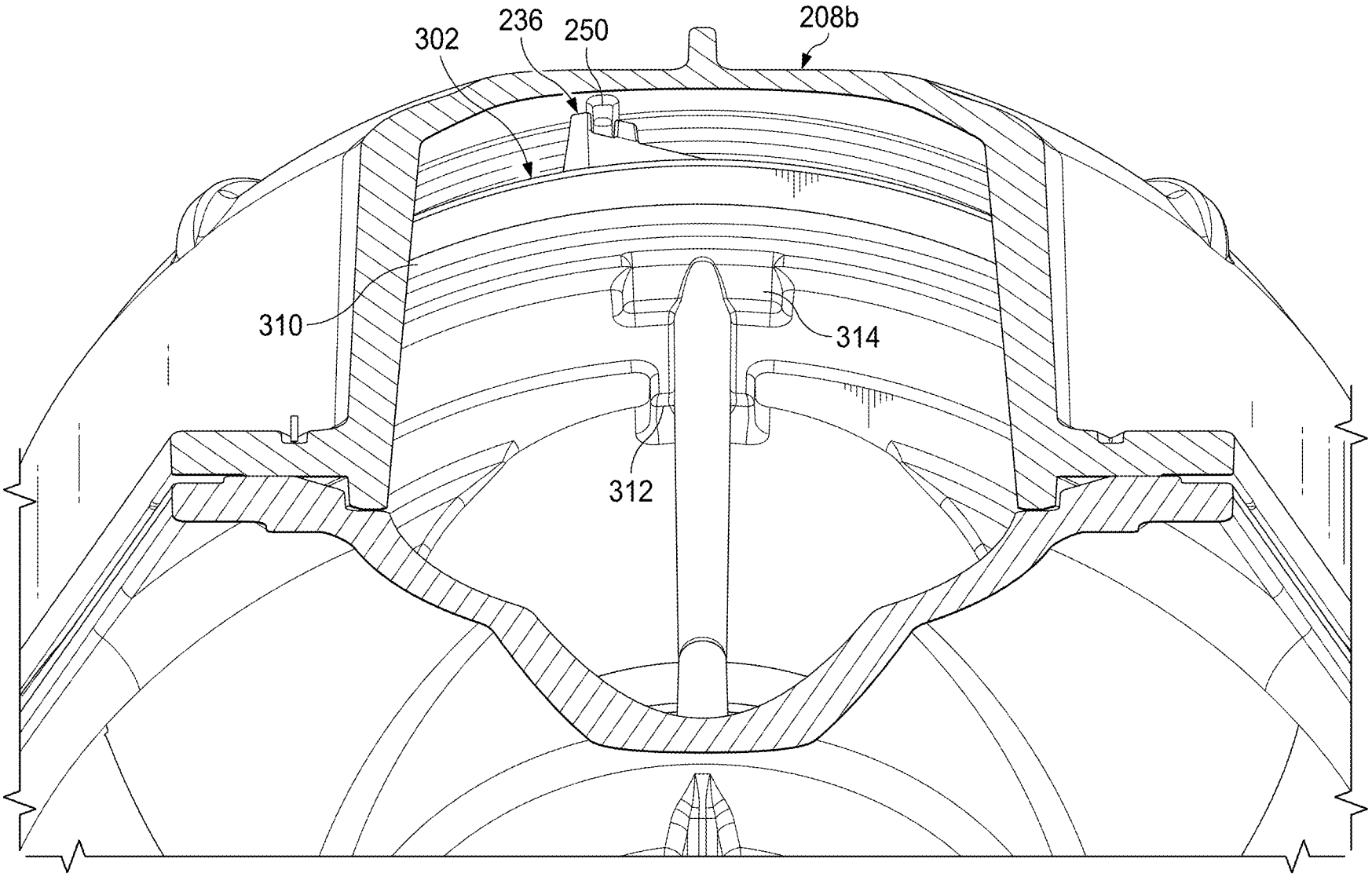
FIG. 43 is a partial front top isometric cutaway view of the pump of FIG. 23.

As shown in FIGS. 38-40, the outlet housing 208*b* of the wet end 200 comprises substantially similar features to the outlet housing 108*b* of the wet end 100, and the description of the outlet housing 108*b* and its corresponding components is incorporated by reference herein with respect to the outlet housing 208*b* and its corresponding components. For example, the outlet housing 208*b* similarly includes an outlet housing flange 214*b*, an outlet housing flange surface 216*b*, a plurality of holes 227, a rear inner wall 218, an alignment lug 220 having a first side surface 224*a* and a second side surface 224*b*, an alignment collar 222 having an inner surface 228*a*, an outer surface 228*b*, and a front surface 228*c*, and a drive shaft aperture 207. The alignment lug 220 of the outlet housing 208*b* can include any and all of the features described above with respect to the alignment lug 120 of the outlet housing 108*b*, and the alignment collar 222 of the outlet housing 208*b* can include any and all of the features described above with respect to the alignment collar 122 of the outlet housing 108*b*. For example, in some forms, the alignment lug 220 is horizontally offset from a plane B (see FIG. 38) that is defined by the axis Y-Y (see FIG. 25) and a center point of a cross-section of the outlet member 211.

As illustrated in FIGS. 41-45, the outlet housing 208*b* includes a number of features that are designed to correspondingly interact with the first diffuser 204*a*, like the features that correspondingly interact in the outlet housing 108*b* with the first diffuser 104. For example, the notch 250 is sized and shaped to at least partially receive the alignment lug 220 to assist with pump assembly and form an anti-rotation mechanism like the notch 150 and the alignment lug 120. Accordingly, the description above with respect to the interaction between the notch 250 and the alignment lug 220 is incorporated by reference herein with respect to the notch 150 and the alignment lug 120. Similarly, the radial alignment surfaces 248 of the vane heads 246 are configured to surround and be slightly offset from the outer surface 228*b* of the alignment collar 222 when the first diffuser 204*a* is properly seated against the outlet housing 208*b*. Accordingly, when the first diffuser 204*a* is being placed against the outlet housing 208*b*, the radial alignment surfaces 248 help the pump assembler properly center the first diffuser 204*a* and prevent accidental lateral movement of the first diffuser 204*a* during assembly.

Figure 44:
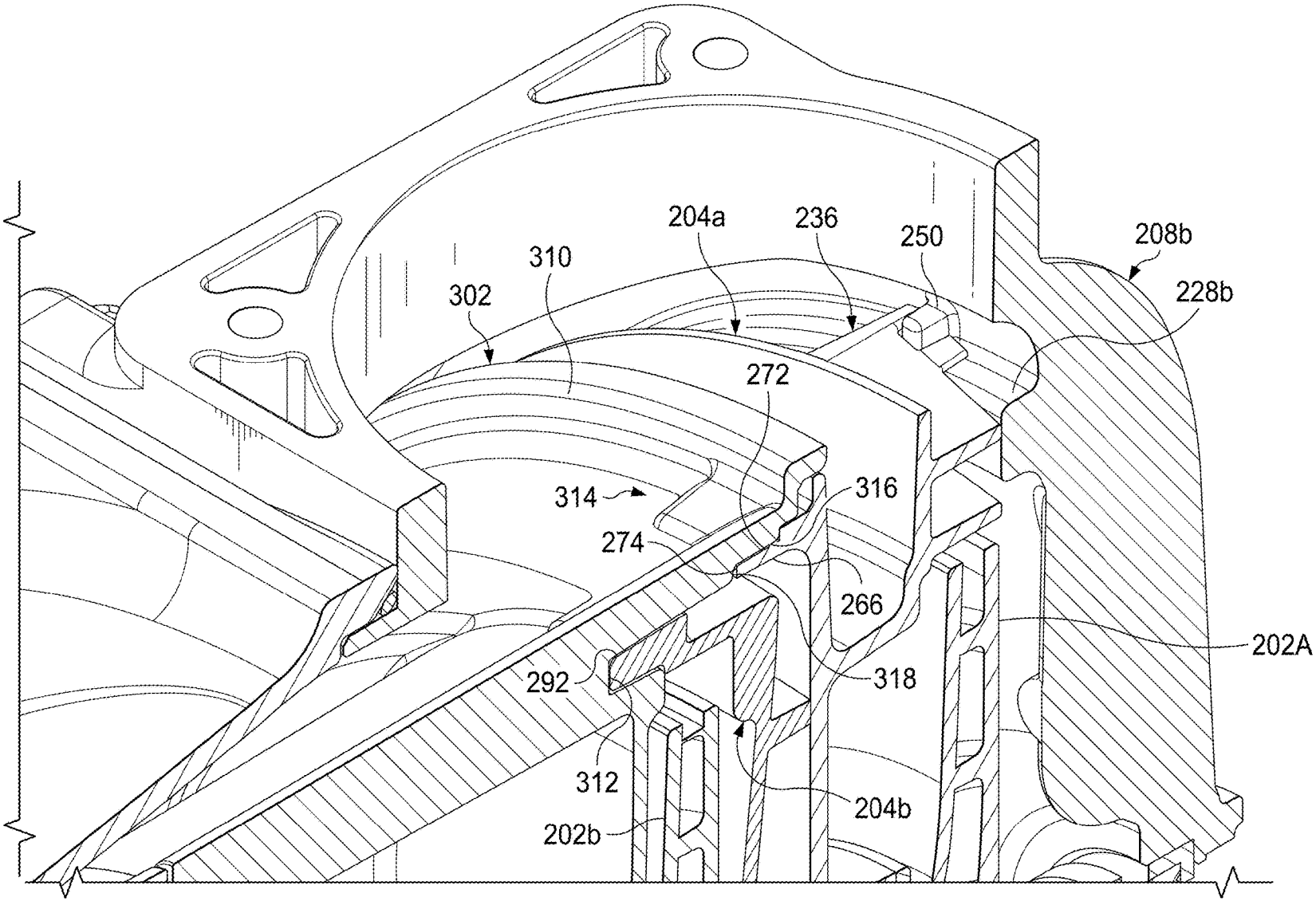
FIG. 44 is a partial front left isometric section view of the pump of FIG. 23 taken along line 25-25 of FIG. 23.
Figure 45:
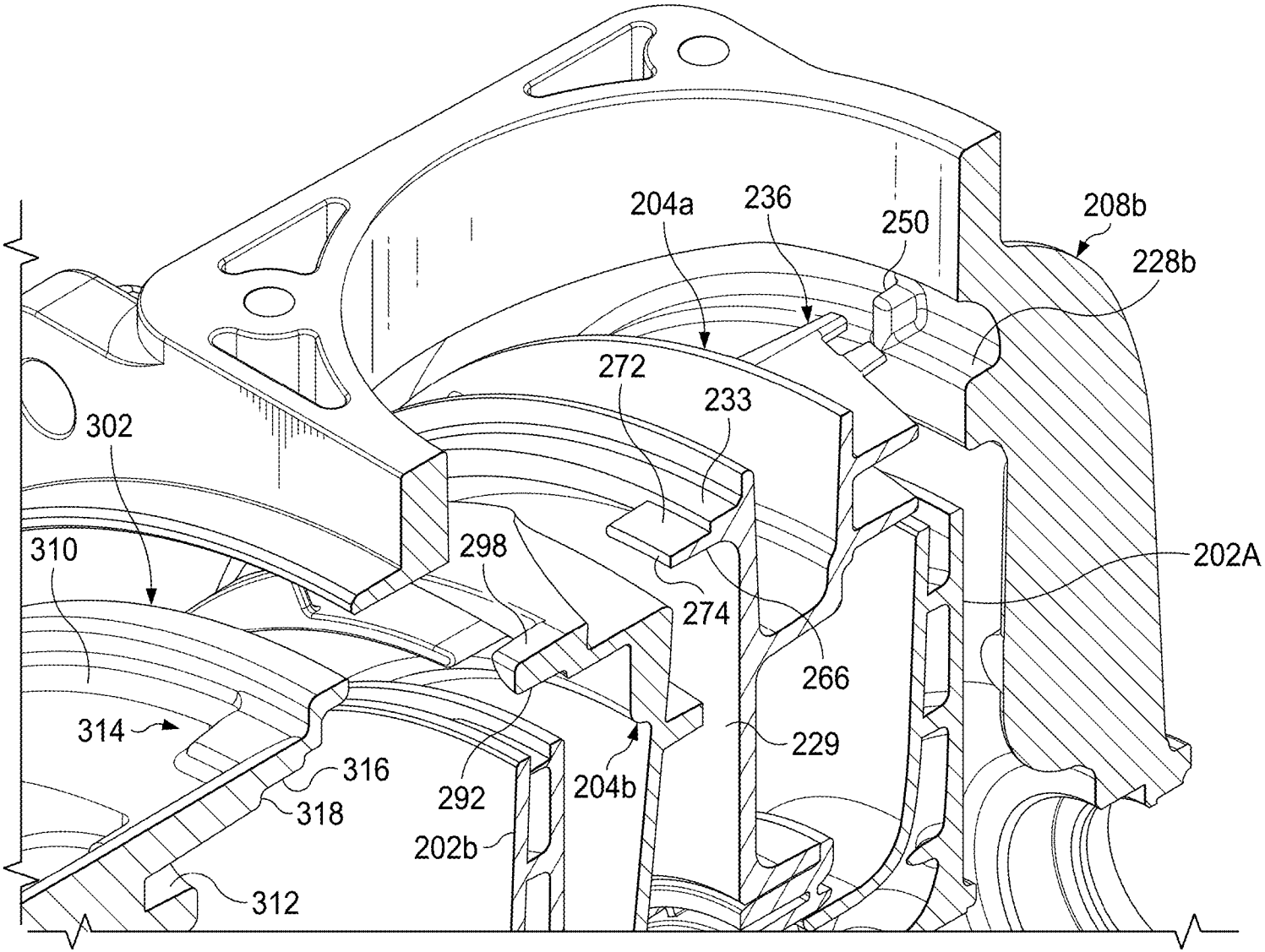
FIG. 45 is an exploded partial isometric section view of the pump of FIG. 23 taken along line 25-25 of FIG. 23.

As illustrated in FIGS. 44 and 45, certain features of the first diffuser 204*a* and the second diffuser 204*b* are designed to correspondingly interact with features of the volute housing 302 to further assist in the proper assembly of the wet end 200 of the pump. For example, the recessed portion 314 is positioned to mate with the alignment tab 266 of the first diffuser 204*a* when the wet end 200 is assembled. Specifically, the top surface 272 of the alignment tab 266 abuts the inner surface 316 of the recessed portion 314 of the volute housing 302. Further, the front surface 274 of the alignment tab 266 abuts the front wall 318 of the recessed portion 314. In some forms, there is a small gap between alignment tab 266 and the front wall 318 of the recessed portion 314 when the wet end 200 is assembled Accordingly, the inner surface 316 of the recessed portion 314 is dimensioned such that the width dimension W1 of the alignment tab 266 is received into the recessed portion 314. When the alignment tab 266 is mated with the recessed portion 314, the circumferential protrusion 233 of the front face 229 will abut the rim 310 of the volute housing 302.

In addition, the alignment post 292 of the second diffuser 204*b* and the blind hole 312 of the volute housing 302 are provided with corresponding three-dimensional geometries such that the alignment post 292 can be received into the blind hole 312. For example, when assembled, the flat surface 298 of the alignment post 292 and the flat surface 322 of the blind hole 312 abut one another. Also, the depth D2 of the blind hole 312 (see FIG. 36) corresponds to the length L1 of the alignment post 292 (see FIG. 34) such that the alignment post 292 makes contact with the bottom of the blind hole 312. In some forms, there is a small gap between alignment post 292 and the bottom of the blind hole 312 when the wet end 200 is assembled. Accordingly, the alignment tab 266 and the recessed portion 314, and the alignment post 292 and the blind hole 312, are designed to assist in the proper alignment of at least the volute housing 302, the first diffuser 204*a*, and the second diffuser 204*b* within the pump housing. Further, if the alignment tab 266 and the recessed portion 314 are not properly mated, or if the blind hole 312 does not properly receive the alignment post 292, the inlet housing 208*a* and the outlet housing 208*b* will not be able to seal together properly. For example, the inlet housing flange surface 216*a* and the outlet housing flange surface 216*b* will not be able to contact one another or properly compress a gasket if the forgoing alignment features are not properly mated.

Thus, an improved pump wet end is provided herein that includes numerous beneficial features such as one or more diffuser anti-rotation mechanisms and one or more pump stage alignment mechanisms. In other embodiments, other configurations are possible. For example, those of skill in the art will recognize, according to the principles and concepts disclosed herein, that various combinations, sub-combinations, and substitutions of the components discussed above can provide appropriate anti-rotation properties and pump stage alignment properties.

What is claimed is:

1. A pump comprising:
an impeller;
a pump housing having
an alignment collar extending axially from an inner surface of the pump housing, and
an alignment lug extending axially from the inner surface of the pump housing and extending radially relative to the alignment collar;
a diffuser having a plurality of vanes, each vane of the plurality of vanes has a vane head on a trailing edge of the vane, the vane head including a radial alignment surface;
a first vane of the plurality of vanes includes a first vane head with a notch and a first radial alignment surface;
the notch is configured to receive the alignment lug to limit rotational movement of the diffuser with respect to the pump housing; and
the first radial alignment surface is positioned adjacent to the alignment collar to limit lateral movement of the diffuser with respect to the pump housing.

2. The pump of claim 1, wherein the diffuser is a first diffuser, the first diffuser includes an alignment tab, and the pump further comprises:
a second diffuser including an alignment post;
a volute housing having a blind hole and a recessed portion positioned on a rim of the volute housing; and
the blind hole is sized and shaped to receive the alignment post and the recessed portion is sized and shaped to receive the alignment tab.

3. The pump of claim 2, wherein the first diffuser has a first face and a second face opposite the first face, the plurality of vanes are positioned on the first face, and the alignment tab is positioned on the second face.

4. The pump of claim 2, wherein the pump housing comprises an inlet housing with an inlet housing flange and an outlet housing with an outlet housing flange, and the inlet housing and the outlet housing are configured to be fastened together by the inlet housing flange and the outlet housing flange to enclose the impeller, the first diffuser, the second diffuser, and the volute housing.

5. The pump of claim 4, wherein the blind hole and the alignment post are sized and shaped such that the inlet housing flange and the outlet housing flange cannot abut one another when the alignment post is not received within the blind hole.

6. The pump of claim 1, wherein each of the radial alignment surfaces is positioned adjacent to the alignment collar to limit lateral movement of the diffuser with respect to the pump housing.

7. The pump of claim 4, wherein the notch and the alignment lug form an anti-rotation mechanism that prevents the diffuser from rotating relative to the outlet housing, and wherein the anti-rotation mechanism requires only one point of rotational contact.

8. The pump of claim 7, wherein the notch comprises a U-shape having a first surface, a second surface, and a third surface, wherein the alignment lug is configured to engage one of the first surface or the second surface when the inlet housing is engaged with the outlet housing.

9. The pump of claim 8, wherein the alignment lug comprises a substantially rectangular prism extending outwardly from the alignment collar on the outlet housing.

10. A method of assembling a pump, comprising:
seating a diffuser against an outlet housing of a pump housing;
engaging a notch on a first vane of the diffuser with an alignment lug projecting axially from an inner surface of the outlet housing and radially relative to an alignment collar projecting axially from the outlet housing such that rotation of the diffuser is limited relative to the outlet housing; and
coupling the outlet housing to an inlet housing to seal the pump housing.

11. The method of claim 10, wherein the notch further comprises a U-shape defined by opposed first and second surfaces and a third surface, and
wherein the alignment lug comprises a substantially rectangular prism extending outwardly from the alignment collar on the outlet housing.

12. The method of claim 11, wherein the step of engaging the notch with the alignment lug further comprises:
inserting the rectangular prism into the U-shape of the notch.

13. The method of claim 11, further comprising:
contacting a front surface of the alignment collar with a rear surface of the first vane, wherein the alignment lug is prevented from engaging the third surface.

14. The method of claim 10, wherein the diffuser is a first diffuser, and the method further comprises:

seating a second diffuser between the first diffuser and a volute housing, wherein the volute housing engages the inlet housing.

15. The method of claim 14, wherein the first diffuser comprises an alignment tab protruding outwardly from a front face of the first diffuser, wherein the volute housing comprises a recessed portion defined on a rear portion of the volute housing, and wherein the method further comprises:

mating the first diffuser with the volute housing by positioning the alignment tab into the recessed portion.

16. The method of claim 14, wherein the second diffuser comprises an alignment post extending outwardly from a second vane on the second diffuser, wherein the volute housing comprises a blind hole on a rear portion of the volute housing, and wherein the method further comprises:

inserting the alignment post into the blind hole.

17. The method of claim 16, further comprising:

compressing a gasket between the inlet housing and the outlet housing to seal the pump housing.

18. The method of claim 17, wherein the step of compressing the gasket cannot be accomplished if the alignment post is not received into the blind hole.

19. A pump diffuser for mounting in a pump housing, the pump diffuser comprising:

a front portion and a rear portion, the rear portion having a plurality of vanes, each vane having a vane head on a trailing edge of the vane, the vane head including a radial alignment surface and wherein a first vane of the plurality of vanes includes a notch, wherein the first vane is configured to engage an alignment collar extending axially from an inner surface of the pump housing to limit lateral movement of the pump diffuser relative to the pump housing, and the notch is configured to engage an alignment lug extending axially from the inner surface of the pump housing and extending radially relative to the alignment collar to limit rotational movement of the diffuser with respect to the pump housing.

20. The pump diffuser of claim 19, wherein the first vane includes a first radial alignment surface, and the first radial alignment surface is configured to engage an outer circumferential surface of the alignment collar.

* * * * *